US012637867B2

(12) United States Patent
Charitou et al.

(10) Patent No.: US 12,637,867 B2
(45) Date of Patent: May 26, 2026

(54) GUARDRAIL POST HOLDER FOR CONSTRUCTION PLATFORM

(71) Applicant: George Charitou, King City (CA)

(72) Inventors: George Charitou, King City (CA); Mubashir Choudhry, Oakville (CA)

(73) Assignee: George Charitou, King City (CA)

( * ) Notice: Subject to any disclaimer, the term of this patent is extended or adjusted under 35 U.S.C. 154(b) by 1319 days.

(21) Appl. No.: 17/403,205

(22) Filed: Aug. 16, 2021

(65) Prior Publication Data

US 2022/0049510 A1 Feb. 17, 2022

Related U.S. Application Data

(60) Provisional application No. 63/066,384, filed on Aug. 17, 2020.

(51) Int. Cl.
*E04G 17/00* (2006.01)
*E04G 5/14* (2006.01)

(52) U.S. Cl.
CPC ..... *E04G 17/002* (2013.01); *E04G 5/145* (2013.01)

(58) Field of Classification Search
CPC ..... E04G 5/14; E04G 5/145; E04G 17/002; E04G 21/3204
See application file for complete search history.

(56) References Cited

U.S. PATENT DOCUMENTS 2,883,241 A * 4/1959 Adolfson ..... E04G 1/14 182/132
3,082,843 A * 3/1963 Henderson ..... E04G 5/045 182/113
3,747,898 A * 7/1973 Warren ..... E04G 21/3242 248/231.51
3,863,900 A * 2/1975 Dagiel ..... E04G 21/3233 248/231.71
3,920,221 A * 11/1975 Berry ..... E04G 21/3233 52/707
3,960,355 A * 6/1976 Prichard, Jr. ..... E04G 17/002 269/208
4,558,968 A 12/1985 Meickl
5,062,733 A 11/1991 Cholid et al.
5,614,122 A 3/1997 Schworer
5,683,609 A 11/1997 Schworer
6,098,751 A * 8/2000 Eichenlaub ..... E04G 3/30 182/222
6,908,075 B1 * 6/2005 Nichols ..... E04G 5/045 182/113

(Continued)

FOREIGN PATENT DOCUMENTS

CA 3141868 C 8/2022
CN 201043354 Y 4/2008

(Continued)

OTHER PUBLICATIONS

Australian Examination Report received from the Australian Government issued in connection with International Application No. 2018347014, dated Dec. 5, 2023.

(Continued)

*Primary Examiner* — Colleen M Chavchavadze

(74) *Attorney, Agent, or Firm* — Carter, DeLuca & Farrell, LLP; George Likourezos

(57) ABSTRACT

A bracket configured to support a guardrail assembly of a construction platform.

5 Claims, 15 Drawing Sheets

(56) References Cited

U.S. PATENT DOCUMENTS

| | | | | |
|---|---|---|---|---|
| 7,201,541 | B2 | 4/2007 | Barmann | |
| 7,360,627 | B2 * | 4/2008 | Scott | A47B 96/061 182/150 |
| 7,530,545 | B2 | 5/2009 | Gillespie et al. | |
| 7,571,888 | B2 | 8/2009 | Arozena Bergaretxe | |
| 7,640,871 | B2 | 1/2010 | Arozena Bergaretxe | |
| 7,971,395 | B1 | 7/2011 | Vigil et al. | |
| 8,051,626 | B2 | 11/2011 | Felix | |
| 8,262,056 | B2 | 9/2012 | Schwoerer | |
| 8,308,126 | B2 * | 11/2012 | Arocena Begareche | E04G 11/50 249/28 |
| 10,053,875 | B1 | 8/2018 | Baron | |
| 10,323,422 | B1 * | 6/2019 | Eddy | E04G 7/00 |
| 10,487,521 | B2 | 11/2019 | Baron et al. | |
| 11,105,105 | B2 | 8/2021 | Charitou et al. | |
| 11,225,802 | B2 | 1/2022 | Charitou et al. | |
| 11,486,154 | B2 * | 11/2022 | Eroglu | E04G 5/14 |
| 11,519,188 | B2 * | 12/2022 | Haeberle | E04G 11/50 |
| 11,585,106 | B2 * | 2/2023 | Schneider | E04G 17/002 |
| 2004/0075043 | A1 | 4/2004 | Arozena Bergaretxe | |
| 2007/0200049 | A1 | 8/2007 | Coday | |
| 2018/0283022 | A1 * | 10/2018 | Gentile | E04G 21/3242 |
| 2019/0010716 | A1 | 1/2019 | Baron et al. | |
| 2019/0010717 | A1 | 1/2019 | Baron et al. | |
| 2019/0063086 | A1 | 2/2019 | Uribeetxebarria Zubia et al. | |
| 2019/0071885 | A1 | 3/2019 | Faresin | |
| 2019/0078340 | A1 | 3/2019 | Faresin | |
| 2021/0095484 | A1 * | 4/2021 | Moeggenborg | E04G 5/062 |
| 2022/0049510 | A1 | 2/2022 | Charitou et al. | |

FOREIGN PATENT DOCUMENTS

| | | | |
|---|---|---|---|
| CN | 202031172 | U | 11/2011 |
| CN | 102587647 | A | 7/2012 |
| DE | 3004245 | A1 | 8/1981 |
| DE | 3316557 | C1 | 10/1984 |
| DE | 3921064 | A1 | 1/1991 |
| DE | 4204773 | A1 | 8/1993 |
| DE | 4305302 | A1 | 8/1994 |
| DE | 19636091 | A1 | 3/1998 |
| DE | 102010001042 | A1 | 7/2011 |
| DE | 102011082841 | A1 | 3/2013 |
| EP | 0054802 | A1 | 6/1982 |
| EP | 0380149 | A1 | 8/1990 |
| EP | 0718453 | A2 | 6/1996 |
| EP | 1251222 | A2 | 10/2002 |
| EP | 1314835 | A1 | 5/2003 |
| EP | 1524386 | A1 | 4/2005 |
| EP | 1617013 | A1 | 1/2006 |
| EP | 2570568 | A2 | 3/2013 |
| EP | 02679744 | A1 | 1/2014 |
| EP | 2749713 | A1 | 7/2014 |
| EP | 3112556 | A1 | 1/2017 |
| EP | 3176349 | A1 | 6/2017 |
| EP | 3202998 | A1 | 8/2017 |
| FR | 2760482 | A1 | 9/1998 |
| FR | 3041010 | A1 | 3/2017 |
| FR | 3021985 | B1 | 5/2018 |
| FR | 3062666 | A1 | 8/2018 |
| GB | 1561377 | A | 2/1980 |
| GB | 2265654 | A | 10/1993 |
| GB | 2265655 | A | 10/1993 |
| GB | 2429031 | A | 2/2007 |
| KR | 100202049 | B1 | 6/1999 |
| KR | 20140112236 | A | 9/2014 |
| MX | 2018009142 | A | 11/2018 |
| WO | 0169014 | A1 | 9/2001 |
| WO | 02084050 | A1 | 10/2002 |
| WO | 2006100694 | A1 | 9/2006 |
| WO | 2010060137 | A1 | 6/2010 |
| WO | 2011089148 | A1 | 7/2011 |
| WO | 2017178460 | A1 | 10/2017 |
| WO | 2019156958 | A1 | 8/2019 |
| WO | 2019202623 | A1 | 10/2019 |
| WO | 2022036445 | A1 | 2/2022 |

OTHER PUBLICATIONS

United Arab Emirates Office Action Examination Report issued by the UAE Intellectual Property Office in connection with International Application No. 6000307 dated Jul. 11, 2023.

Indian Office Action including English translation, dated Jan. 14, 2021, issued in corresponding Indian Application No. 202017008149, 6 pages.

Extended European Search Report dated Apr. 23, 2021, issued in corresponding European Application No. 18866931, 10 pages.

Translation of DE 4305302 A1, (Peri GmbH). (Year: 1994).

Canadian International Search Report issued by the Canadian Intellectual Property Office in connection with International Application No. PCT/CA2018/050994, dated Nov. 7, 2018.

Canadian Written Opinion issued by the Canadian Intellectual Property Office in connection with International application No. PCT/CA2018/050994, dated Nov. 7, 2018.

Japanese Office Action issued by the Japanese Patent Office in connection with Japanese Patent Application No. 2020-514717, dated Feb. 13, 2023. (English Translation Attached).

Chinese Office Action dated Aug. 4, 2021 (10 pages), issued in corresponding CN Appln. No. 201880055640 including English translation (12 pages), total of 22 pages.

Korean Office Action issued by the Korean Patent Office in connection with International Applicaton No. 10-2020-7006197, dated May 19, 2023. (English Translation Attached).

Examination Report issued by the Canadian Patent Office in connection with International Application No. 3,073,439 dated Sep. 14, 2023.

Examiner's Report received by the Canadian Patent Office in connection with International Application No. 3,165,281, dated Oct. 5, 2023.

International Search Report dated Nov. 16, 2021, issued in corresponding international application No. PCT/CA2021/051138, 14 pages.

* cited by examiner

GUARDRAIL POST HOLDER FOR CONSTRUCTION PLATFORM

CROSS-REFERENCE TO RELATED APPLICATION

This application claims the benefit of and priority to U.S. Provisional Patent Application No. 63/066,384, filed on Aug. 17, 2020, the entire contents of which are incorporated by reference herein.

TECHNICAL FIELD

This document relates to the technical field of (and is not limited to) (A) guardrail post holder for use with a construction platform (and method therefor); and/or (B) a synergistic combination of a construction platform and a guardrail post holder (and method therefor).

BACKGROUND

Shoring is a process of temporarily supporting a structure (such as a building, a vessel, a trench) with shores (also called props or supports) when there is a danger of collapse of the structure or during construction, repairs or alterations (of the structure). Shoring may be vertical, angled, or horizontal. A prop (also called a prop assembly) is an object (also called a support) placed beneath or against a structure to keep the structure from falling or shaking.

SUMMARY

It will be appreciated that there exists a need to mitigate (at least in part) at least one problem associated with known systems for connecting, and supporting, guardrail systems of construction platforms (also called the existing technology). After much study of, and experimentation with, the existing (known) guardrail systems, an understanding (at least in part) of the problem and its solution have been identified (at least in part) and are articulated (at least in part) as follows:

Falsework (and any equivalent thereof) is defined as any temporary structure used to support a permanent structure while the permanent structure is not self-supporting. Formwork (and any equivalent thereof, such as a formwork platform or formwork system) is defined as the system of support for freshly placed concrete, including the mold (mould) or sheathing, supporting members, hardware, and necessary bracing, but excluding the falsework. A shore (also called a prop) is a falsework component defined as a vertical or inclined support member designed to support the weight of the formwork, concrete, and construction loads. A guardrail system may include a guardrail post holder, and is defined as an assembly of components joined together to provide a barrier to prevent a worker from falling from the edge of a surface. During the processes of erecting the formwork, the placing of concrete, and the stripping and removal of formwork, safety regulations require the use of a fall protection system configured to provide effective fall protection for workers.

Falls are a cause of critical injuries and deaths of workers on construction sites. A reliable (and convenient way) to protect workers from an unwanted fall is by installing guardrails.

A guardrail system may be used if a worker has access to the perimeter or an open side of a platform (such as, a floor, a roof, the surface of a bridge, a scaffold platform, other work platform, runway or ramp, etc.), and/or if the worker may be exposed to a fall of at least a specific height (such as about 2.4 metres or more).

There are various types of known guardrail systems and/or methods by which such systems might be secured (whether permanently or temporarily) to the open edges of a work platform. Guardrail systems are configured to withstand loads as defined in relevant construction standards. With respect to guardrail systems installed along the open edges of formwork platforms, one type of known guardrail system features post holders (securely mounted to components of the formwork and/or falsework) that receive vertical guardrail posts to which horizontal guardrails may be attached. These types of known drop-in guardrail systems are configured to be dismantled and reused.

It will be appreciated that the known guardrail system may include vertical guardrail posts and horizontal guardrails, etc., and any equivalent thereof.

What may be needed is a novel guardrail post holder (or guardrail post bracket) configured to connect, and supporting, a guardrail system to a construction platform; for instance, the novel guardrail post holder (or guardrail post bracket) may be configured to receive a vertical guardrail post of the guardrail system.

What may be required is a guardrail post holder configured to attach to a formwork system (comprising panels, beams, prop heads, etc.) to enable convenient and/or safe installation of vertical guardrail posts (to which horizontal guardrails are subsequently attached to secure the formwork perimeter and/or provide a physical barrier against unwanted falls).

What may be needed is a novel guardrail post holder configured to be securely attached to the formwork system (also called a formwork platform) so that the guardrail post holder may subsequently receive a vertical guardrail post to which horizontal guardrails are attached (to create a safely enclosed perimeter).

What may be needed is a novel guardrail post holder having unique design features (configurations) configured to securely attach to the various components of the formwork system) for the purpose of receiving the vertical guardrail posts.

What may be needed is a novel guardrail post holder having at least one or more configurations for securely attaching to various components (such as, the beam head, the prop head, the beam side, beam underside, etc.) of the formwork system, and configured to receive the vertical guardrail posts (to which horizontal guardrails are subsequently attached to create a safely enclosed perimeter).

To help ensure (at least in part) a safely enclosed perimeter, it may be desirable to provide the guardrail post holders configured to be securely attached to the formwork system; this may be accomplished by attaching the guardrail post holders in specific ways to either the beam head, the prop head, the beam side, the beam underside (etc.) by using a combination of specific (unique) geometries and/or specific mechanisms.

It may be desirable to provide the guardrail post holder configured to be attached to various components of the formwork system (such as the beam head, the prop head, the beam side, the beam underside, etc.), and also configured to receive a vertical guardrail post (at these various mounted positions and/or for resisting any relevant applied loads in accordance with regulatory requirements).

It may be desirable to provide the guardrail post holder configured to support at least one component of a guardrail system (such as vertically-extending guardrail posts); the guardrail post holders are configured to secure the vertical guardrail posts at various positions located at the formwork system (such as, the beam head, the prop head, the beam side, the beam underside, etc.), and resist relevant applied loads. The horizontal guardrails (such as, the top rail, the mid-rail, the toe-board or the wireframe fence) are installed in place to the vertical guardrail posts, etc.

It may be desirable to provide the guardrail post holders configured to interact with (support) at least one or more components of a guardrail system (such as vertical guardrail posts, etc.).

It may be desirable to provide the guardrail post holder configured to support the components of a guardrail system (such as the vertical guardrail posts) at any of a number of locations positioned at the formwork platform or formwork system (such as, along an edge of the formwork platform) to sufficiently facilitate the installation of a fall-protection barrier.

To mitigate, at least in part, at least one problem associated with the existing technology, there is provided (in accordance with a major aspect) an apparatus. The apparatus includes and is not limited to (comprises) a guardrail post holder configured for use with a construction platform (also called a formwork system, a formwork platform, etc.). For instance, the construction platform may, for instance, include (and is not limited to) a combination of props, prop heads, beams and panels, etc., and any equivalent thereof) For instance, the panels are positioned on, and span between and are supported by, beams, and the beams are supported on prop heads; the prop heads are respectively mounted to the props. The guardrail post holder is also configured to receive a vertical guardrail post.

To mitigate, at least in part, at least one problem associated with the existing technology, there is provided (in accordance with a major aspect) an apparatus. The apparatus includes and is not limited to (comprises) a construction platform; and a guardrail post holder configured to receive a vertical guardrail post; the guardrail post holder is also configured to be attached to at least one or more components of the construction platform. For instance, the construction platform may include (and is not limited to) props, prop heads mounted to the props, beams supported on prop heads; and panels positioned on the beams.

In one aspect of the present disclosure, a guardrail post holder for coupling a guardrail assembly to a formwork system is provided. The guardrail post holder includes a spine, a socket, and a plate. The spine has a top end portion, and a bottom end portion. The socket is coupled to the top end portion of the spine and configured for receiving a guardrail post of the guardrail assembly. The plate is coupled to the bottom end portion of the spine and configured to selectively secure the guardrail post holder to a formwork support component of the formwork system.

In aspects, the plate may include a pair of plates coupled to the bottom end portion of the spine and laterally spaced from one another to define a gap therebetween. The gap may be configured to receive an end of the formwork support component to prevent the guardrail post holder from rotating about a longitudinal axis of the formwork support component.

In aspects, the guardrail post holder may further include a safety pin. The pair of plates may each define a hole therethrough configured for receipt of the safety pin.

In aspects, the guardrail post holder may further include a stop plate spanning the gap and interconnecting the pair of plates. The stop plate may be configured for flush engagement with a head of the formwork system.

In aspects, the guardrail post holder may further include a panel seat extending perpendicularly relative to the stop plate. The panel seat may be configured to support a cantilevering portion of a panel of the formwork system.

In aspects, the bottom end portion of the spine may have an inclined support surface.

In aspects, the guardrail post holder may further include a toe-board stop plate protruding outwardly from the socket to maintain a gap between the formwork support component of the formwork system and the top end portion of the spine.

In aspects, the plate may extend perpendicularly from the bottom end portion of the spine and has a pair of stabilizer plate tabs protruding upwardly from the plate. The pair of stabilizer plate tabs may be configured to cradle around a bottom section of the formwork support component.

In aspects, the guardrail post holder may further include a clamp head rotationally coupled to the plate and configured to rotate between a first position and a second position. In the first position, the clamp head is disengaged from the bottom section of the formwork support component. In the second position, the clamp head lockingly engages the bottom section of the formwork support component.

In aspects, the guardrail post holder may further include an actuation bar extending along a length of the spine and being operably coupled to the clamp head such that the clamp head rotates from the first position to the second position in response to a translation of the actuation bar from a first position to a second position.

In aspects, the guardrail post holder may further include a spring-actuated plunger pin coupled to the top end portion of the spine and configured to selectively lock the actuation bar in the second position.

In aspects, the actuation bar may define a hole therein, and the spring-actuated plunger pin may be configured to slide into the hole of the actuation bar when the actuation bar is moved to the second position.

In aspects, the guardrail post holder may further include a guardrail post seat extending from the spine and defining a slot. The spring-actuated plunger pin may have a bent tail end configured to rotate into the slot when the spring-actuated plunger pin slides into the hole of the actuation bar to provide a visual indication that the clamp head is in the second position.

In aspects, the guardrail post holder may further include a stabilizer plate coupled to a middle portion of the spine and configured to cradle under a beam flange of the formwork support component.

In aspects, the guardrail post holder may further include a pivot arm pivotably coupling the socket to the top end portion of the spine.

In aspects, the guardrail post holder may further include two additional sockets coupled to the pivot arm.

In aspects, the pivot arm may be configured to rotate relative to the top end portion of the spine between a plurality of positions to adjust an orientation of the socket and the two additional sockets.

In aspects, the guardrail post holder may further include a pair of channel plates coupled to a middle portion of the spine and configured to receive a prop head hook of the formwork support component therebetween.

In aspects, the guardrail post holder may further include a safety pin. Each of the pair of channel plates may define a hole therein configured for receipt of the safety pin to detachably couple the pair of channel plates to the prop head hook.

In aspects, the guardrail post holder may further include a torsional resistance plate extending from the middle portion of the spine and having a pair of pins extending downwardly. The pair of pins may be configured for receipt in a base plate of the formwork support component.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify potentially key features or possible essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which:

FIG. 13 is a side view illustrating the guardrail post holder of FIG. 5 attached to the cross beam;

FIG. 23 is a perspective view illustrating two of the guardrail post holders of FIG. 14 engaged with the side of the beam;

FIG. 27 is an enlarged perspective view of the guardrail post holder of FIG. 24;

Figure 1:
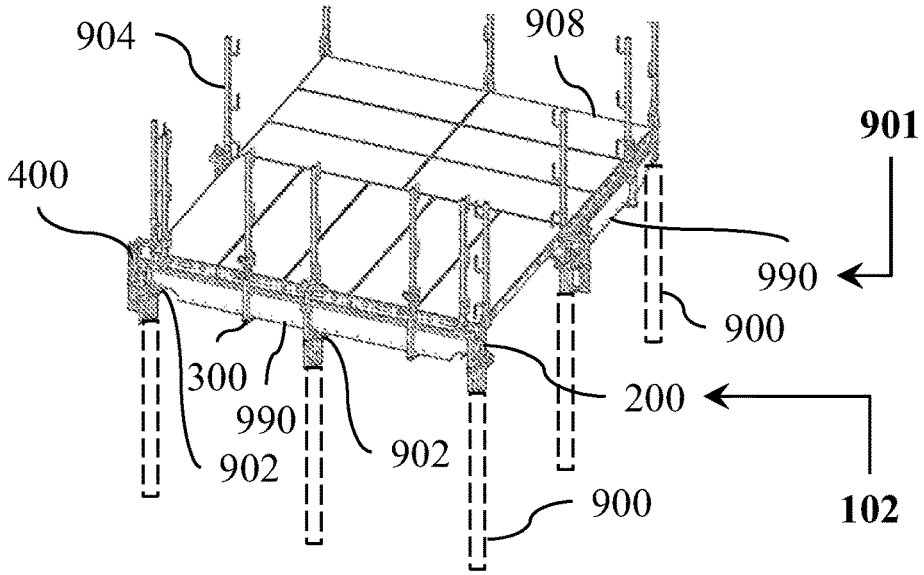
FIG. 1 is a perspective view of a construction system including a construction platform and a guardrail post holder.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, and well-understood, elements that are useful in commercially feasible embodiments are often not depicted to provide a less obstructed view of the embodiments of the present disclosure.

LISTING OF REFERENCE NUMERALS USED IN THE DRAWINGS guardrail post holder 102
beam-end guardrail post bracket 200
guardrail post socket 201
toe-board stop plate 202
guardrail post seat 203
structural reinforcement gusset 204
structural reinforcement plate 206
panel seat 208
main plate 210
structural reinforcement skirt 212
stabilizer plates (214A, 214B)
safety-pin hole 216
safety-pin hole 218
beam-head stop plate 220
support surface 222
angled clearance 223
beam-side guardrail post bracket 300
guardrail post socket 301
flat-bar 302
guardrail post seat 303
trigger 304
plunge hole 305
spring-actuated plunger pin 306
plunger-pin slot 307
stabilizer plates (308A, 308B)
compression spring 309
clamp head 310
fixed pin 311
stabilizer-plate tabs (312A, 312B)
stabilizer plate 313
base plate 314
clamp-head pivot pin 316
pin slot 317
hinge bolt 318
stabilizer plate 319
central tube 320
prop-head guardrail post bracket 400
guardrail post socket (401A, 401B, 401C)
plunge-hole plate 402
engagement-plunge hole (403A, 403B, 403C)
pivot arm 404
same elevation height 405
spring-actuated plunger pin 406
pivot point 407
safety-pin receivers (408A, 408B)
channel plates 409A, 409B
stabilizer plate 410
compression spring 411
torsional resistance pin (412A, 412B)
base member 413
stabilizer plate 414
torsional-resistance plate 418
prop 900
construction platform 901
prop head 902
prop-head hook 903
vertical guardrail post 904
post hook 905
horizontal guardrails 906
toe board 907A
mid-rail 907B
top-rail 907C
panel 908
gap 909
beam-end area 911
safety pin 912
dashed line 913
rack 914
main-beam head 916
cross-beam head 917
beam-slope angle 918
tilt direction 920
prop-head horizontal base plate 924
pin-receivers 925
horizontal load 927
prop-head horizontal top section 929

-continued beam 990
engagement channel 991
main beam 992
beam flange 993
cross beam 994
receiver channel 995
lateral beam flanges 996
beam flange 997

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the disclosure is defined by the claims. For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the disclosure is limited to the subject matter provided by the claims, and that the disclosure is not limited to the particular aspects depicted and described. It will be appreciated that the scope of the meaning of a device configured to be coupled to an item (that is, to be connected to, to interact with the item, etc.) is to be interpreted as the device being configured to be coupled to the item, either directly or indirectly. Therefore, "configured to" may include the meaning "either directly or indirectly" unless specifically stated otherwise.

FIG. 1, FIG. 2, FIG. 3 and FIG. 4 depict perspective views of a guardrail post holder 102 for use with a construction platform 901.

Referring to the embodiments (implementations) as depicted in FIG. 1 to FIG. 4, the construction platform 901 may be called a formwork platform, a formwork system, etc., and any equivalent thereof. The construction platform 901 may include, for instance, panels 908 that are positioned on, span between and supported by beams 990 (such as, main beams 992 or cross beams 994), and the beams 990 are supported on prop heads 902, and the prop heads 902 are respectively mounted to props 900.

Referring to the embodiments (implementations) as depicted in FIG. 1 to FIG. 4, a construction platform 901 is depicted. A guardrail post holder 102 is configured to receive a vertical guardrail post 904. The guardrail post holder 102 is also configured to be attached to at least one or more components of the construction platform 901. For instance, the construction platform 901 may include (and is not limited to) props 900 (vertically extending elongated elements); prop heads 902 mounted to (the distal sections of) the props 900; beams 990 to be supported on the prop heads 902; the beams 990 spanning across at least two instances of the prop heads 902; and (an array of) panels 908 positioned on the beams 990.

Referring to the embodiments (implementations) as depicted in FIG. 1 to FIG. 4, there is depicted a construction platform 901 (such as, a formwork platform, a formwork system, etc.). A guardrail post holder 102 is configured to be attached to a component of the construction platform 901. The guardrail post holder 102 is also configured to support a component of a guardrail system. For instance, the guardrail post holder 102 is also configured to receive a vertical guardrail post 904 of the guardrail system).

Referring to the embodiments (implementations) as depicted in FIG. 1 to FIG. 4, the construction platform 901 includes (and is not limited to) props 900 configured to be mounted to, and extend from, a working surface (such as the ground, etc.). Prop heads 902 are configured to be respectively mounted to the props 900. Beams 990 are configured to be supported on the prop heads 902. Panels 908 are configured to be positioned on, spanning between and supported the beams 990. The guardrail post holder 102 is (preferably) also configured to be attached to at least one of the beams 990.

Figure 2:
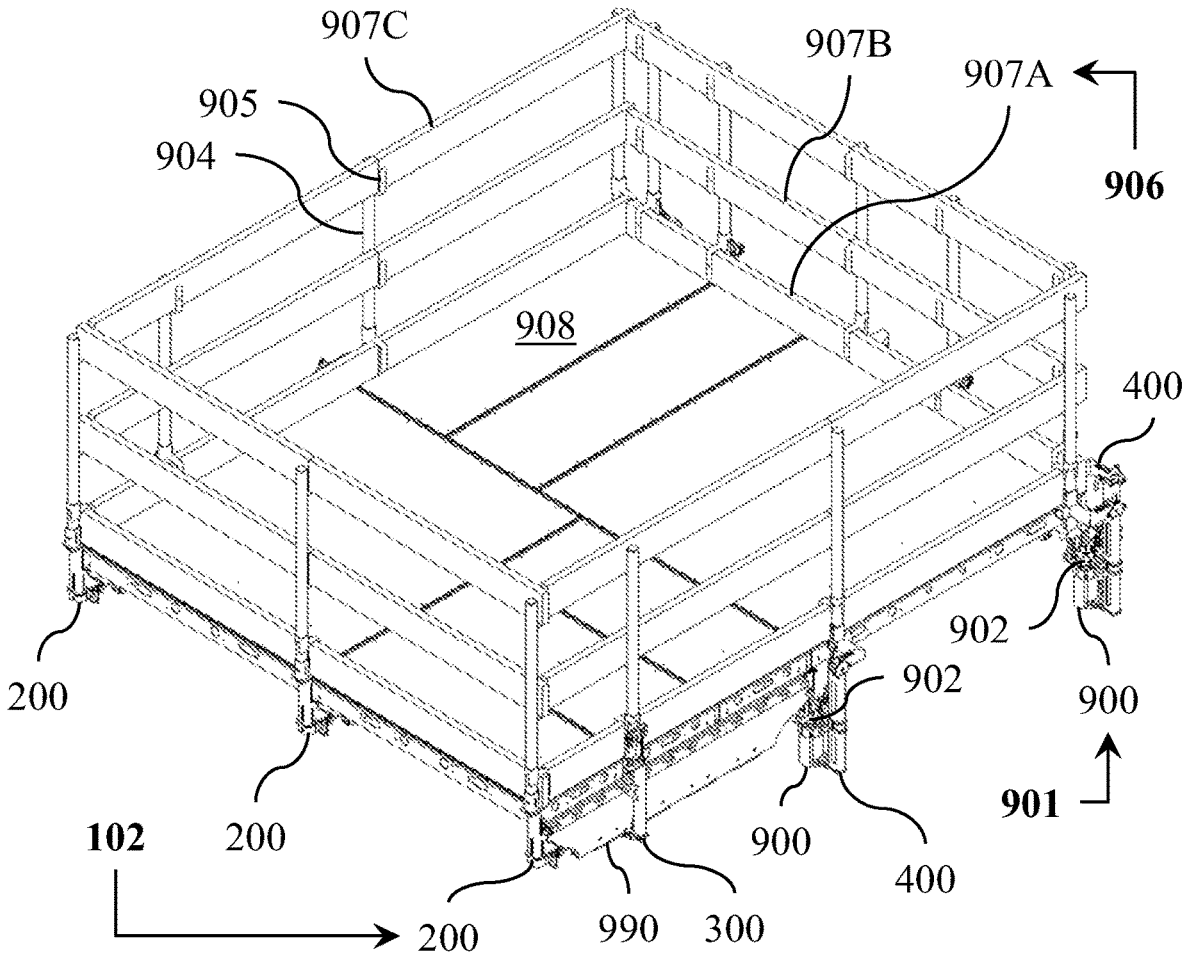
FIG. 2 is an enlarged perspective view illustrating the guardrail post holder of FIG. 1 with a guardrail assembly attached thereto.

Referring to the embodiments (implementations) as depicted in FIG. 1, FIG. 2, FIG. 3 and FIG. 4, the prop head 902 is installed to a top section of the prop 900. The prop 900 is securely installed to the ground or a working surface. The beams 990 are installed to the prop head 902. The guardrail post holder 102 is installed to the beams 990 and/or the prop head 902. There are three types or configurations of the guardrail post holder 102. The guardrail post holder 102 may include the beam-end guardrail post bracket 200, the beam-side guardrail post bracket 300 and the prop-head guardrail post bracket 400. The vertical guardrail post 904 is installed to the guardrail post holder 102. The post hook 905 is configured to extend from the vertical guardrail post 904. The horizontal guardrails 906 (a component of a guardrail system) is configured to extend between adjacently positioned instances of the vertical guardrail posts 904. A guardrail system may include horizontal guardrails 906 (and any equivalent thereof), vertical guardrail posts 904 (and any equivalent thereof) configured to support (and to which are attached) the horizontal guardrails 906, etc. The horizontal guardrails 906 may include a toe board 907A, a mid-rail 907B and a top-rail 907C. An equivalent to the horizontal guardrails 906 may include timber boards (elements). Another equivalent to the horizontal guardrails 906 may include a metal wireframe fence configured to hook in (connect) with the vertical guardrail posts 904. The horizontal guardrails 906 are configured to be held in place by the vertical guardrail posts 904, which are securely installed in one of the guardrail post holders 102, to create a safely enclosed perimeter along the edges of the panels 908 (also called formwork panels) to protect against falling, as depicted in FIG. 2). The guardrail post holders 102 and any equivalent thereof may include the beam-end guardrail post bracket 200, the beam-side guardrail post bracket 300 or the prop-head guardrail post bracket 400, etc.). The guardrail post holder 102 may include different types or configurations, such as the beam-end guardrail post bracket 200, the beam-side guardrail post bracket 300 or the prop-head guardrail post bracket 400. The panels 908 span between (are supported on) the beams 990 (whether the main beams 992 and/or the cross beams 994). The beams 990 are supported by (or, span between) the prop heads 902 and the props 900 positioned underneath. The guardrail post holder 102 is configured to receive and hold the vertical guardrail post 904. The vertical guardrail post 904 is mounted to the guardrail post holder 102. The beam-end guardrail post bracket 200 is configured to be attached to the beam end section of the beam 990 (specifically the main-beam head 916 or the cross-beam head 917). The beam-side guardrail post bracket 300 is configured to be attached to either side of a beam 990 (such as the main beam 992 or the cross beam 994). The prop-head guardrail post bracket 400 is configured to be attached to the prop head 902.

FIG. 5 to FIG. 13 depict a perspective view (FIG. 5), a side view (FIG. 6), a perspective view (FIG. 7), side views (FIG. 8 and FIG. 9), a close-up side view (FIG. 10), a side view (FIG. 11), a perspective view (FIG. 12) and a side view (FIG. 13) of embodiments of the guardrail post holder 102 of FIG. 1, in which the guardrail post holder 102 includes a beam-end guardrail post bracket 200.

Figure 5:
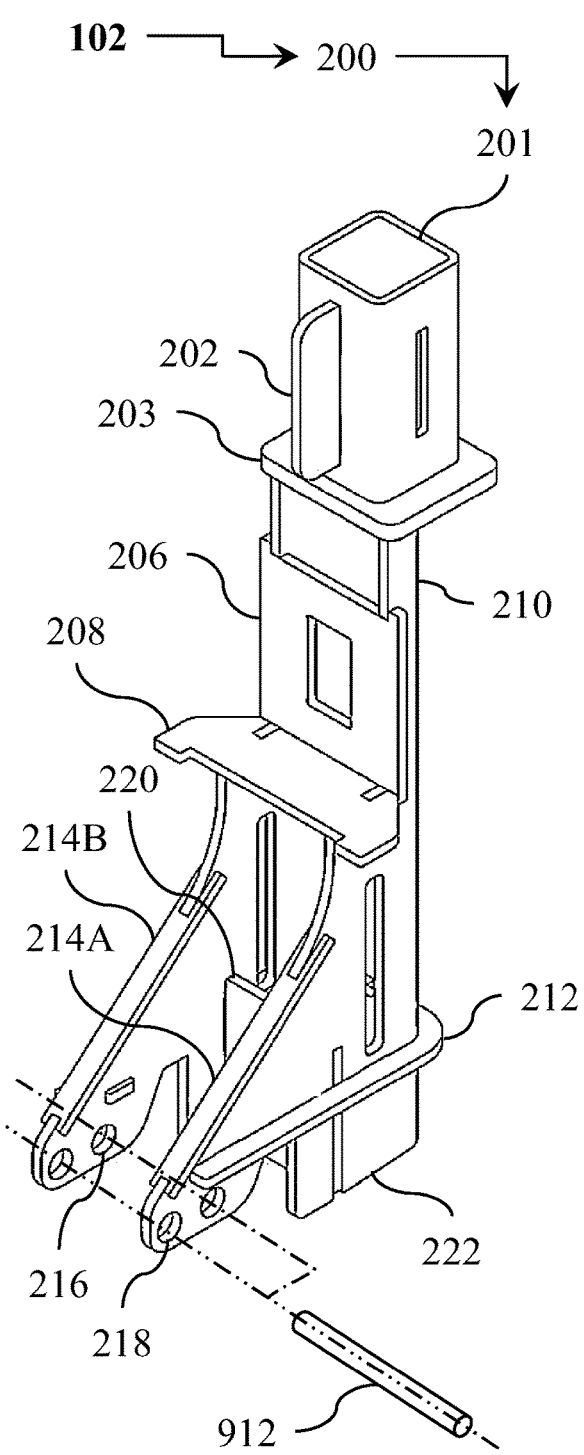
FIG. 5 is a perspective view of the guardrail post holder of FIG. 2.
Figure 6:
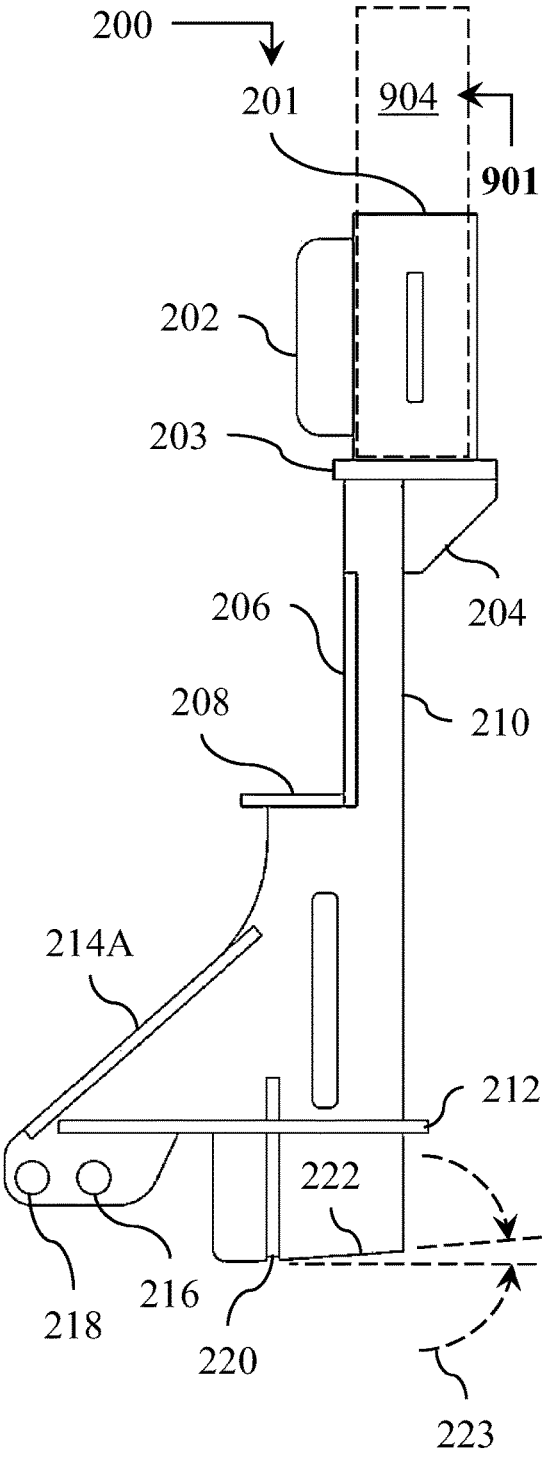
FIG. 6 is a side view of the guardrail post holder of FIG. 5.
Figure 7:
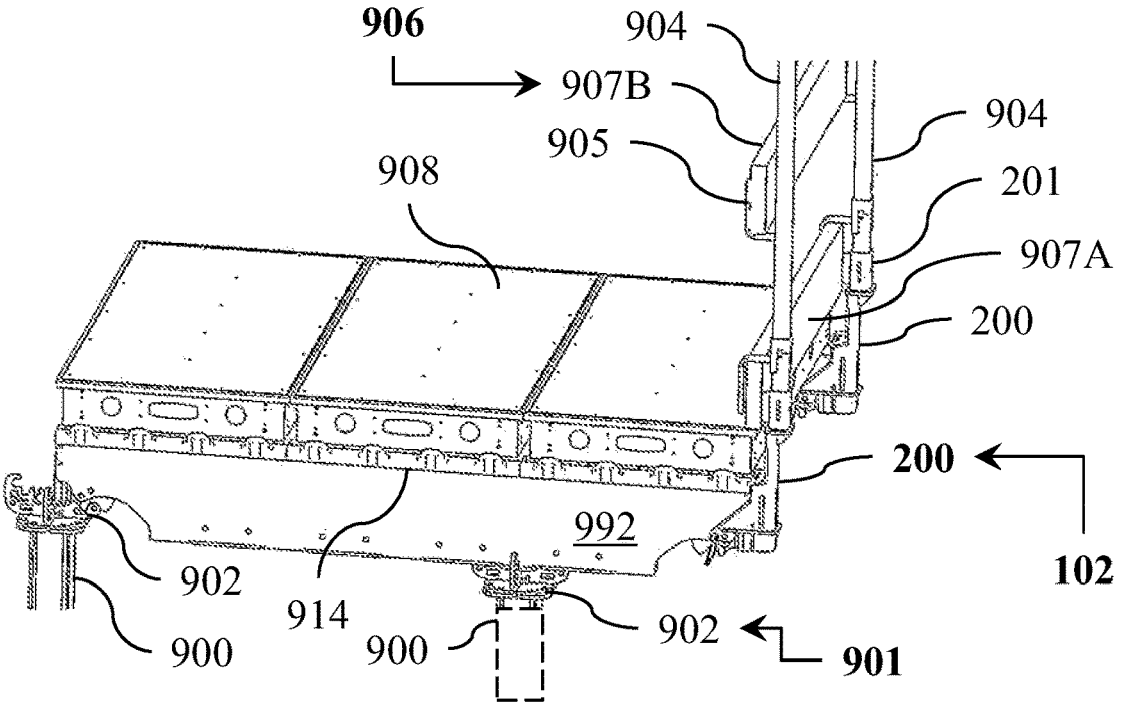
FIG. 7 is a perspective view of two of the guardrail post holders of FIG. 5 attached to the construction platform.
Figure 8:
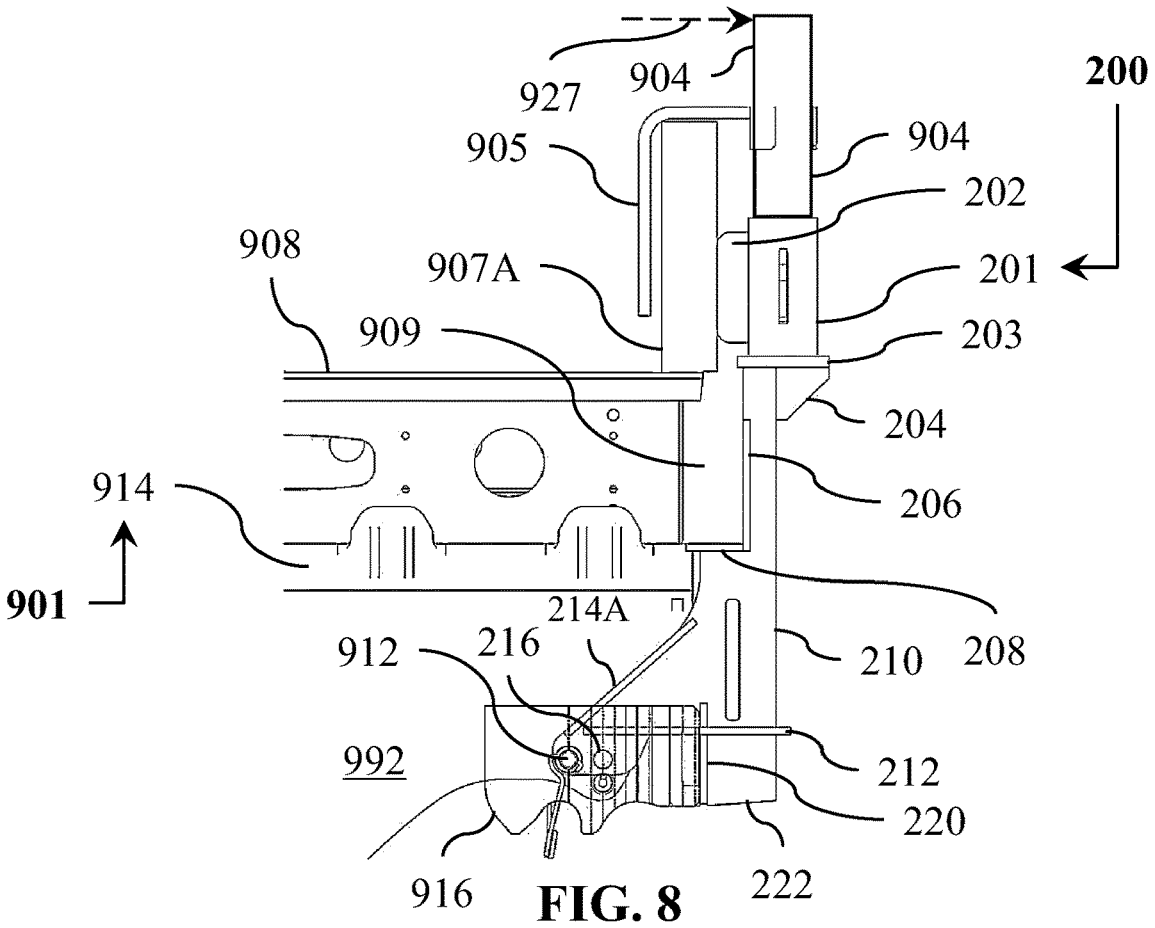
FIG. 8 is a side view of the guardrail post holder of FIG. 5 attached to a main beam of the construction platform.
Figure 9:
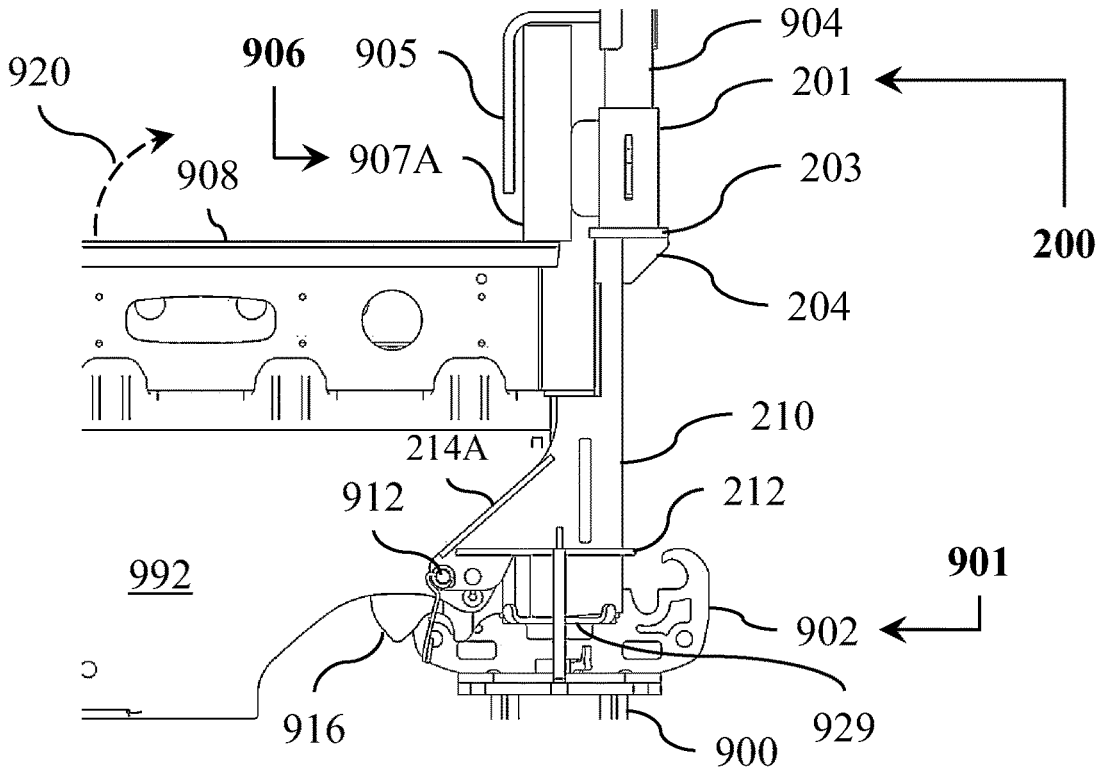
FIG. 9 is a side view of the guardrail post holder of FIG. 5 attached to the main beam and supported on a prop of the construction platform.
Figure 10:
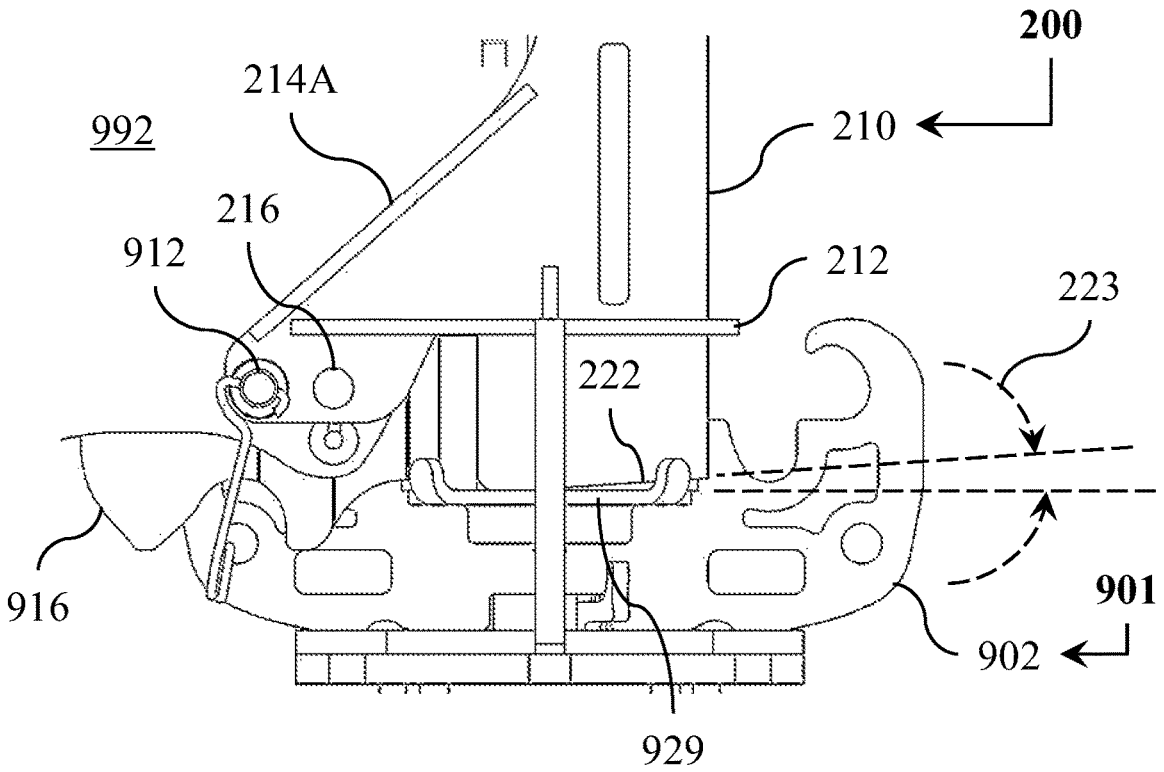
FIG. 10 is an enlarged side view illustrating a bottom end section of the guardrail post holder of FIG. 9 attached to the main beam and the prop.
Figure 11:
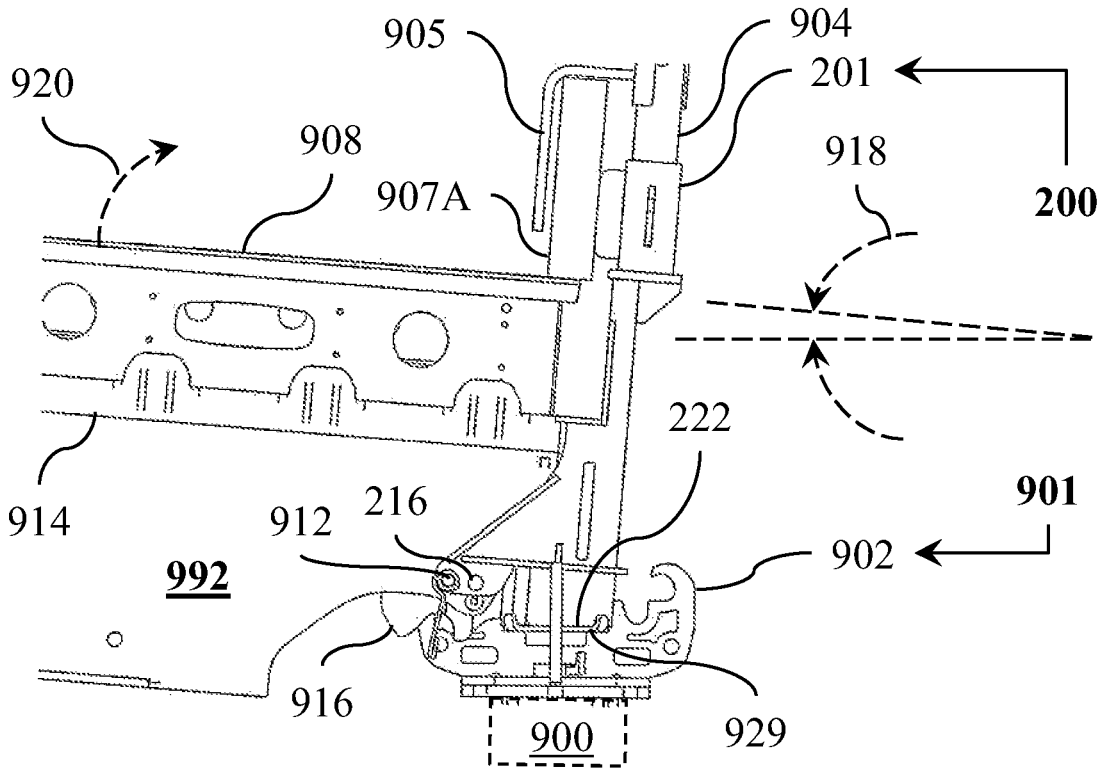
FIG. 11 is a side view illustrating the main beam and guardrail post holder of FIG. 9 in a tilted position relative to the prop.
Figure 12:
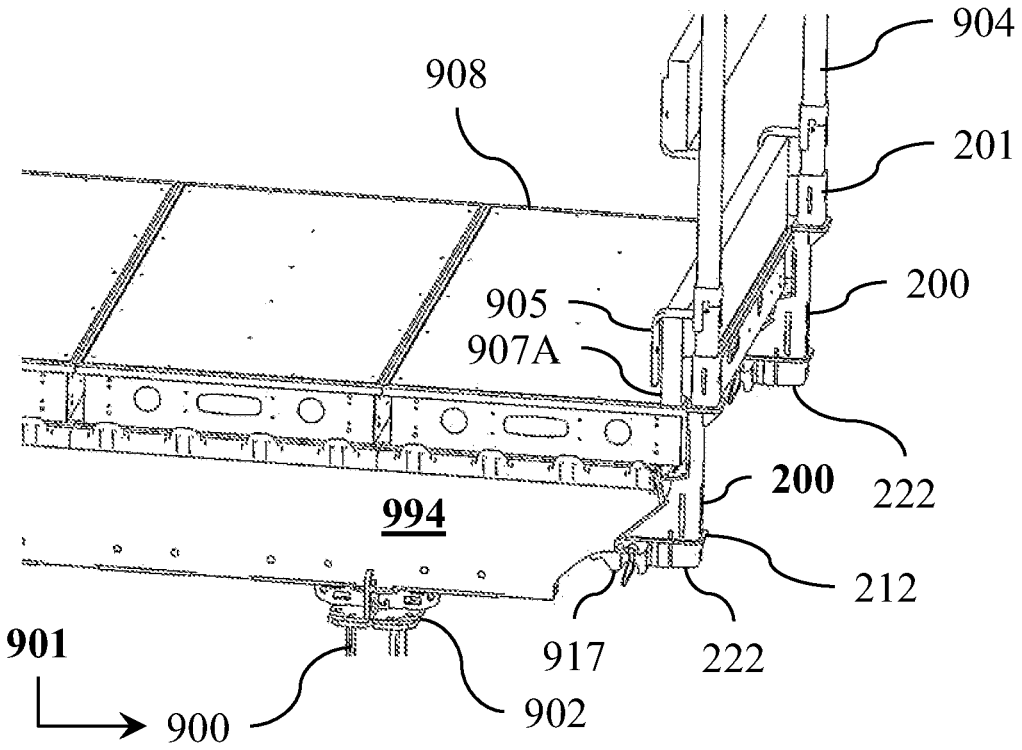
FIG. 12 is a top perspective view illustrating the guardrail post holder of FIG. 5 attached to a cross beam of the construction platform.

Referring to the embodiments (implementations) as depicted in FIG. 5, FIG. 6 and FIG. 7, the beam-end guardrail post bracket 200 is configured to be attached, with a safety pin 912, to the end portion of the main beam 992 (that is, at the main-beam head 916) or to the end portion of the cross beam 994 (that is, at the cross-beam head 917). For the scenario in which the beam-end guardrail post bracket 200 is attached to the main beam 992 (as depicted in FIG. 7 to FIG. 9), the safety pin 912 goes into the safety-pin hole 218 (depicted in FIG. 5 and FIG. 6). For the scenario in which the beam-end guardrail post bracket 200 is attached to the cross beam 994 (as depicted in FIG. 12 and FIG. 13), the safety pin 912 goes into the safety-pin hole 216. The beam-end guardrail post bracket 200 is configured to be attached to the end of a beam 990 when the beam is cantilevering (in which case there is no prop head 902 supporting the end of the beam 990, as depicted in FIG. 7, FIG. 8, FIG. 12 and FIG. 13), or when there is a prop head 902 supporting the main-beam head 916 underneath (as depicted in FIG. 9, FIG. 10 and FIG. 11). The beam-end guardrail post bracket 200 includes a guardrail post socket 201 configured to receive the vertical guardrail post 904. The beam-end guardrail post bracket 200 includes the toe-board stop plate 202. The beam-end guardrail post bracket 200 includes the guardrail post seat 203. The guardrail post seat 203 is the base on which the vertical guardrail post sits (rests thereon) so it does not fall through the guardrail post socket 201. The beam-end guardrail post bracket 200 includes the structural reinforcement gusset 204. The beam-end guardrail post bracket 200 includes the structural reinforcement plate 206. The structural reinforcement plate 206 provides critical resistance against the bending of main plate 210 when there is a horizontal load applied or transmitted to the vertical guardrail post 904. The beam-end guardrail post bracket 200 incudes the panel seat 208.

Referring to the embodiments (implementations) as depicted in FIG. 5, FIG. 6 and FIG. 7, the beam-end guardrail post bracket 200 includes a spine, such as, for example, the main plate 210. The main plate 210 is made using a metal forming process. For instance, the main plate 210 may be formed by bending a flat sheet of metal using bending dies; the main plate 210 is the main formed plate of the bracket, and the main plate 210 is configured to cradle around (at least in part) the main-beam head 916 or cross-beam head 917 of a beam 990 (for the case where the beam-end guardrail post bracket 200 is attached to the beam 990). The structural reinforcement skirt 212 adds structural rigidity to the main plate 210. The stabilizer plates (214A, 214B) are configured to prevent the beam-end guardrail post bracket 200 from rotating around the longitudinal axis of the beam 990 when the beam-end guardrail post bracket 200 is attached to the beam 990. The safety pin 912 is configured to securely attach the beam-end guardrail post bracket 200 to the main-beam head 916 (as depicted in FIG. 8) or the cross-beam head 917 (as depicted in FIG. 13), thereby preventing disengagement of the bracket from the main-beam head 916 or the cross-beam head 917. The safety-pin hole 216 is for use when the beam-end guardrail post bracket 200 is attached to the cross beam 994. The safety-pin hole 216 is configured to receive a safety pin 912 (when attaching to the cross beam 994 (as depicted in FIG. 13, which is a close-up view of FIG. 12). The safety-pin hole 218 is for use when the beam-end guardrail post bracket 200 is attached to the main beam 992. The safety-pin hole 218 is configured to receive a safety pin 912 when the beam-end guardrail post bracket 200 is attached to the main beam 992 (as depicted in FIG. 8, FIG. 9, FIG. 10 and FIG. 11). When the beam-end guardrail post bracket 200 is attached to the beam 990, the beam-head stop plate 220, in use, engages with the main-beam head 916 (see FIG. 8) or with the cross-beam head 917 (see FIG. 13) to prevent overturning of the beam-end guardrail post bracket 200.

Referring to the embodiment (implementation) as depicted in FIG. 8, there is depicted a close-up view of the beam-end guardrail post bracket 200 installed at the end of the main beam 992. When the horizontal load 927 is transmitted by the vertical guardrail post 904 to the beam-end guardrail post bracket 200, the beam-head stop plate 220, in use, engages with the main-beam head 916, and the beam-head stop plate 220 prevents the beam-end guardrail post bracket 200 from rotating around the safety-pin hole 218. The safety pin 912 also prevents the bracket from disengaging from the main-beam head 916.

Referring to the embodiments (implementations) as depicted in FIG. 8, the toe-board stop plate 202 prevents the toe board 907A from sliding back and falling through the gap 909 (the gap 909 is formed between the end face of the panels 908 and the structural reinforcement plate 206 of the beam-end guardrail post bracket 200 when the beam-end guardrail post bracket 200 is attached to the main-beam head 916). The beam-head stop plate 220 (of the beam-end guardrail post bracket 200) is configured to engage with the main-beam head 916 or with the cross-beam head 917 to prevent unwanted overturning of the beam-end guardrail post bracket 200 due to the effect of gravity or the effect of an applied horizontal load.

Referring to the embodiments (implementations) as depicted in FIG. 6, FIG. 8, FIG. 10 and FIG. 11, the inclined support surface 222 is depicted. The inclined support surface 222 is angled upward from the horizontal. The angled clearance 223 is formed between the inclined support surface 222 and the prop-head horizontal top section 929 (as depicted in FIG. 10). The main-beam head 916 is resting on the prop-head horizontal top section 929 of the prop head 902. The beam 990 is tilted, and the panel 908 tilts with the beam 990 (there is the beam-slope angle 918 that the beam 990 makes with the horizontal). The panel 908 tilts with the beam 990 (as depicted FIG. 11). The beam-end guardrail post bracket 200 is attached to the main-beam head 916 (as depicted in FIG. 9, FIG. 10 and FIG. 11), and the prop head 902 is located underneath the main-beam head 916. When the main beam 992 is oriented to slope at the beam-slope angle 918 (as depicted in FIG. 11), the guardrail post socket 201 tilts with the main beam 992 (this tilting of the beam-end guardrail post bracket 200 is facilitated by the angled clearance 223, shown in FIG. 10, between the inclined support surface 222 and the prop-head horizontal top section 929). As the beam is tilted to slope at the beam-slope angle 918, the inclined support surface 222 is configured to prevent interference with the prop-head horizontal top section 929 that is positioned underneath the inclined support surface 222. The prop-head horizontal top section 929, in use, contacts the inclined support surface 222. Preferably, the angled clearance 223 becomes, ideally, zero once (after) the beam reaches its maximum instance of the beam-slope angle 918 (as depicted in FIG. 11). It will be appreciated that the beam-end guardrail post bracket 200 may be attached to the end of the beam 990 prior to raising (installing) the beam 990 and attaching the beam 990 to the prop head 902. Alternatively, the beam 990 may already be installed and span between two props 900 and supported on the prop heads 902 after which the beam-end guardrail post bracket 200 may be attached to the main-beam head 916 or the cross-beam head 917 of the beam 990 (depending on the type of beam, etc.).

Referring to the embodiment (implementation) as depicted from FIG. 7 to FIG. 11, the beam-end guardrail post bracket 200 is attached to the main-beam head 916 of the main beam 992. In this arrangement, a hole in the main-beam head 916 that receives the safety pin 912 lines up coaxially with the safety-pin hole 218 of the beam-end guardrail post bracket 200. The safety pin 912 is inserted into the safety-pin hole 218 (thereby securely attaching the beam-end guardrail post bracket 200 to the main-beam head 916). The safety-pin hole 216 of the beam-end guardrail post bracket 200 is empty, and the safety pin 912 cannot be inserted in the safety-pin hole 216 because when the beam-end guardrail post bracket 200 is used with the main beam 992, there is no hole in the main-beam head 916 of the main beam 992 that lines up coaxially with the safety-pin hole 216 of the beam-end guardrail post bracket 200. The safety pin 912 is used to securely attach the beam-end guardrail post bracket 200 to the main-beam head 916 or the cross-beam head 917, thereby preventing disengagement of the coupled components. The safety pin 912 couples (attaches) the beam-end guardrail post bracket 200 to the main-beam head 916; in this scenario, the safety pin 912 goes into the safety-pin hole 218 of the beam-end guardrail post bracket 200. The main-beam head 916 is included at each end of the main beam 992. The beam-end guardrail post bracket 200 cradles around the main-beam head 916 (as depicted in FIG. 7 to FIG. 11).

Referring to the embodiment (implementation) as depicted from FIG. 7 and FIG. 8 (FIG. 8 is a close-up view of FIG. 7), the beam-end guardrail post bracket 200 is attached to the end of the main beam 992 (that is, to the main-beam head 916), where the main beam 992 is cantilevering (that is, the prop head 902 is not utilized for supporting the main-beam head 916 at the end of the main beam 992). The bracket is secured to the main-beam head 916 with a safety pin 912. The vertical guardrail post 904 slides into the guardrail post socket 201 of the beam-end guardrail post bracket 200.

Referring to the embodiment (implementation) as depicted in FIG. 8, the rack 914 (also called a plastic rack) runs along the top length of the beam and on which the panels spanning between beams may sit (rest thereon). The rack 914 includes upwardly protruding flanges configured to position and hold the panels 908 in place (relative to the beams 990).

Referring to the embodiments (implementations) as depicted in FIG. 9, FIG. 10 and FIG. 11, the prop head 902 supports the main-beam head 916 of main beam 992, and the beam-end guardrail post bracket 200 is attached to the main-beam head 916. While the beam-end guardrail post bracket 200 was previously shown (in FIG. 7 and FIG. 8) as being attached to the beam head of a beam 990 when the beam is cantilevering (that is, there is no supporting prop head 902 and prop 900 under the beam head), the beam-end guardrail post bracket 200 can also be attached to the beam head when there is a prop head 902 supporting the beam head underneath (as shown in FIG. 9, FIG. 10 and FIG. 11). The beam-end guardrail post bracket 200 cradles around and attaches to the main-beam head 916 via the safety pin 912, in the same manner as with a cantilevering beam (when there is no prop head 902 positioned underneath the main-beam head 916). This works with the beam 990 (such as either the main beam 992 or the cross beam 994). The cross-beam head 917 is included at each end of the cross beam 994. It will be appreciated that there is no view of the cross-beam head 917 supported by a prop head 902; the reason is that the cross beam 994 may be cantilevered (that is, there is no prop head 902 and prop 900 supporting the cross-beam head 917 from underneath) when the beam-end guardrail post bracket 200 is attached to the cross beam 994 (as depicted in FIG. 12 and FIG. 13). In cases when the cross-beam head 917 is supported by a prop head 902 and a guardrail post is required at the cross-beam head 917, the beam-end guardrail post bracket 200 may still be attached to the cross-beam head 917, in a similar manner as described above, in which the safety pin 912 is inserted through the safety-pin hole 216 of the beam-end guardrail post bracket 200 to attach the beam-end guardrail post bracket 200 to the cross-beam head 917.

Referring to the embodiment (implementation) as depicted in FIG. 10, the inclined support surface 222 (of the beam-end guardrail post bracket 200) is angled upward from the horizontal so that the bracket can be attached to the main-beam head 916 when the main-beam head 916 is sitting on the prop head and the main beam 992 is inclined at an angle (from the horizontal). This angled surface creates (forms) the angled clearance 223, ensuring that the beam-end guardrail post bracket 200 can tilt with the inclined main beam 992 and not interfere with the prop-head horizontal top section 929 of the prop head 902 underneath.

Referring to the embodiment (implementation) as depicted in FIG. 11, the beam-end guardrail post bracket 200 is attached to the main-beam head 916 when there is a prop head 902 underneath the main-beam head 916 and the main beam 992 is inclined at the beam-slope angle 918 from the horizontal. Once the main beam 992 reaches the maximum amount of the beam-slope-angle 918, the inclined support surface 222 (in use) contacts (at least in part) the prop-head horizontal top section 929 (that is, the angled clearance 223 becomes, ideally, zero).

FIG. 12 and FIG. 13 (FIG. 13 is a close-up view of FIG. 12) depict a cross beam 994 (which is positioned to be cantilevered), and the beam-end guardrail post bracket 200 is attached to the cross-beam head 917 of the cross beam 994.

FIG. 13 depicts a close-up view of the beam-end guardrail post bracket 200 installed at the end of the cross beam 994 (that is, attached to the cross-beam head 917). For the case where the horizontal load 927 is transmitted at the guardrail post socket 201, the beam-head stop plate 220 engages with the cross-beam head 917, and the beam-head stop plate 220 is configured to prevent the beam-end guardrail post bracket 200 from rotating around the safety-pin hole 216. The safety pin 912 also prevents the bracket from disengaging from the cross-beam head 917. The safety-pin hole 216 lines up with a hole in the cross-beam head 917, thereby allowing the safety pin 912 to be inserted into the safety-pin hole 216 and couple (attach) the beam-end guardrail post bracket 200 to the cross-beam head 917. When the beam-end guardrail post bracket 200 is used with the cross beam 994, it will not be possible to put the safety pin 912 in the safety-pin hole 218. The safety pin 912 is used to securely attach the beam-end guardrail post bracket 200 to the cross-beam head 917 to prevent disengagement of the beam-end guardrail post bracket 200 from the cross-beam head 917. The safety pin 912 is inserted into the safety-pin hole 216 of the beam-end guardrail post bracket 200 when the bracket is attached to the cross-beam head 917 (as shown in FIG. 12 and FIG. 13). The safety pin 912 is inserted into the safety-pin hole 218 of the beam-end guardrail post bracket 200 when the bracket is attached to the main-beam head 916 (as depicted from FIG. 7 to FIG. 11).

Referring to the embodiment (implementation) as depicted from FIG. 12 and FIG. 13, the beam-end guardrail post bracket 200 is attached to the cross-beam head 917 of the cross beam 994. In this arrangement, a hole in the cross-beam head 917 that receives the safety pin 912 lines up coaxially with the safety-pin hole 216 of the beam-end guardrail post bracket 200 (the safety pin 912 is inserted into the safety-pin hole 216, thereby securely attaching the beam-end guardrail post bracket 200 to the cross-beam head 917). The safety-pin hole 218 is empty, and the safety pin 912 cannot be inserted in the safety-pin hole 218 because when the beam-end guardrail post bracket 200 is used with the cross beam 994, there is no hole in the cross-beam head 917 of the cross beam 994 that lines up coaxially with the safety-pin hole 218 of the beam-end guardrail post bracket 200. The safety pin 912 couples (attaches) the beam-end guardrail post bracket 200 to the cross-beam head 917; in this scenario, the safety pin 912 goes into the safety-pin hole 216 of the beam-end guardrail post bracket 200. The cross-beam head 917 is included at each end of the cross beam 994. The beam-end guardrail post bracket 200 cradles around the cross-beam head 917 (as depicted in FIG. 12 and FIG. 13).

Referring to the embodiments as depicted in FIG. 12 and FIG. 13, the beam-end guardrail post bracket 200 is attached to the cross-beam head 917 of the cross beam 994. FIG. 13 is a close-up of the beam-end guardrail post bracket 200 attached to the cross-beam head 917 of the cross beam 994. FIG. 12 shows a zoomed out view of the cross beams 994 with the beam-end guardrail post bracket 200 is attached at the cross-beam head 917. Although the cross-beam head 917 for the cross beam 994 is similar to the main-beam head 916 of the main beam 992 (as depicted in FIG. 5 to FIG. 11), the beam heads may have subtle differences in geometries and in the position of the holes that receive the safety pin 912. The safety-pin hole 216 of the beam-end guardrail post bracket 200 is configured to receive the safety pin 912 when the beam-end guardrail post bracket 200 is attached to the cross-beam head 917 of the cross beam 994. The safety-pin hole 218 is configured to receive the safety pin 912 when the beam-end guardrail post bracket 200 is attached to the main-beam head 916 of the main beam 992.

Referring to the embodiment (implementation) as depicted in FIG. 13, depicted is a close-up of the beam-end guardrail post bracket 200 attached to the cross-beam head 917 of a cross beam 994. The cross beam 994 is cantilevered (that is, there is no prop head 902 and prop 900 supporting the cross-beam head 917 of the cross beam 994). The beam-end area 911 is angled backwardly causing a portion of the panel 908 to cantilever (in use). The dashed line 913 indicates the portion of the panel 908 that cantilevers at the edge of the cross beam 994; this cantilevering portion is supported by the panel seat 208 of the beam-end guardrail post bracket 200. The beam-end guardrail post bracket 200 attaches to the cross-beam head with a safety pin 912 inserted through the safety-pin hole 216. The beam-head stop plate 220 is configured to prevent inadvertent (unwanted) overturning of the beam-end guardrail post bracket 200 due to the effect of gravity or the effect of an applied horizontal load directed to the beam-end guardrail post bracket 200. The safety-pin hole 218 does not have a safety pin received therein (and it cannot physically receive a safety pin), because the cross-beam head 917 of the cross beam 994 does not have a hole that coaxially lines up with the safety-pin hole 218. For the case where the last instance of the panel 908 sits on (rests on) the rack 914 of the cross beam 994, the geometry of the cross beam 994 is different from the main beam 992; the end of the cross beam 994 is angled back from the vertical, which causes a small portion of the panel 908 to cantilever out from the beam surface underneath. In this scenario, the panel seat 208 on the beam-end guardrail post bracket 200 supports the cantilevering portion of the panel 908.

FIG. 14 to FIG. 23 depict a perspective view (FIG. 14), side views (FIG. 15, FIG. 16, FIG. 17 and FIG. 18), close-up side views (FIG. 19 and FIG. 20) and perspective views (FIG. 21, FIG. 22 and FIG. 23) of embodiments of the guardrail post holder 102 of FIG. 1, in which the guardrail post holder 102 includes a beam-side guardrail post bracket 300.

Figure 14:
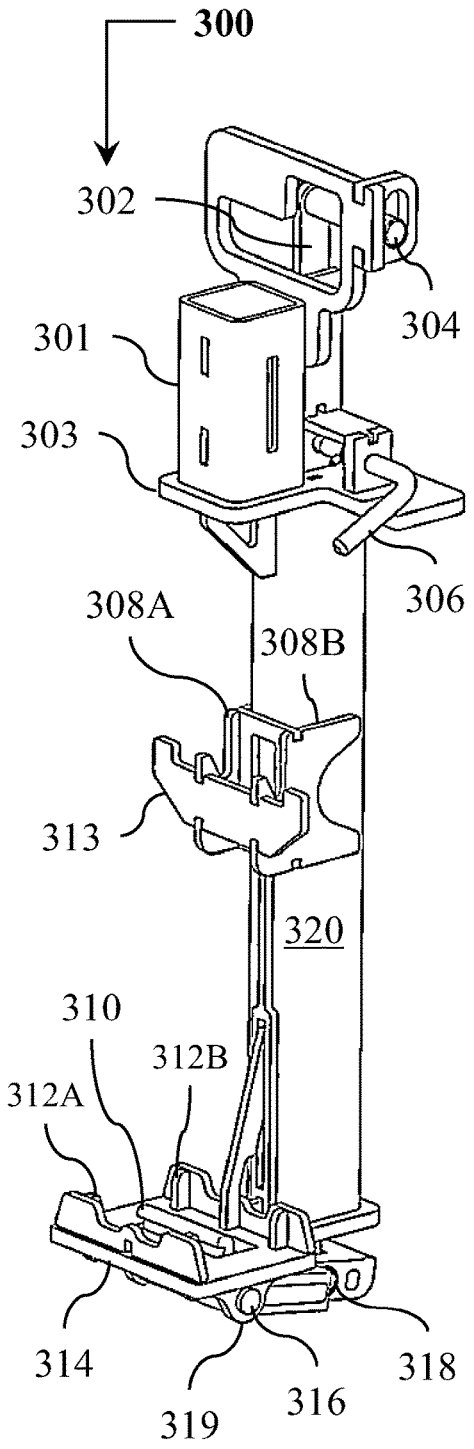
FIG. 14 is a perspective view illustrating another embodiment of a guardrail post holder configured for attachment to a side of the construction platform.
Figure 15:
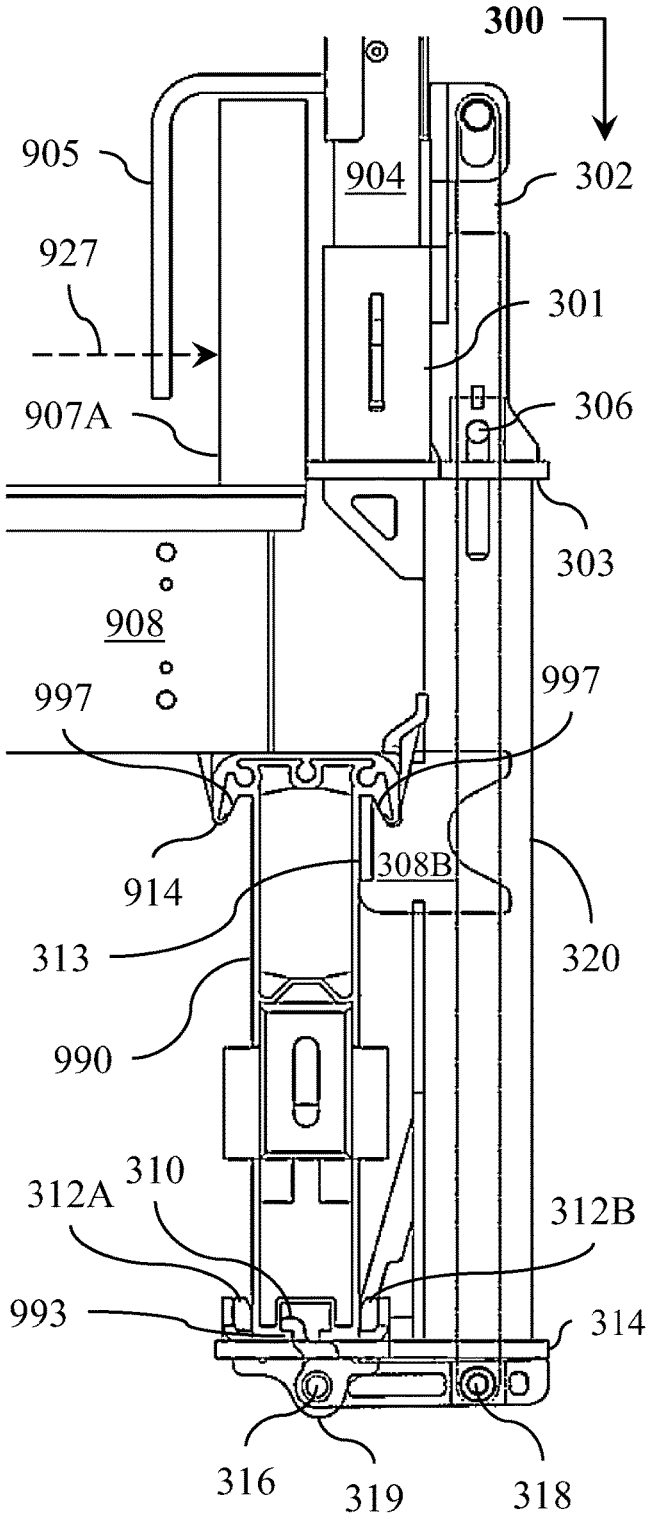
FIG. 15 is a side view illustrating the guardrail post holder of FIG. 14 attached to a side of a beam of the construction platform.

Referring to the embodiments (implementations) as depicted in FIG. 14 (a perspective view) and FIG. 15 (a side view), the beam-side guardrail post bracket 300 includes a guardrail post socket 301, a flat bar 302, a guardrail post seat 303, a trigger 304, and an articulated clamp head 310. The guardrail post socket 301 is configured to receive the vertical guardrail post 904. The flat-bar 302 may include a vertical flat-bar, a rod and any equivalent thereof. The flat-bar 302 is configured to engage and release the articulated clamp head 310 (up and down motion to engage and release the articulated clamp head 310). The trigger 304 is configured to (manually) actuate the flat-bar 302.

Figure 18:
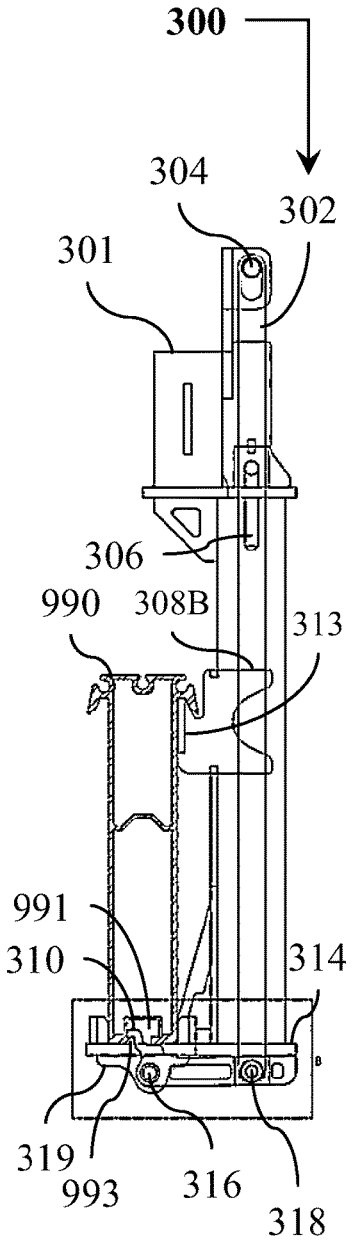
FIG. 18 is a side view illustrating the guardrail post holder of FIG. 15 in a locked state with the side of the beam.
Figure 19:
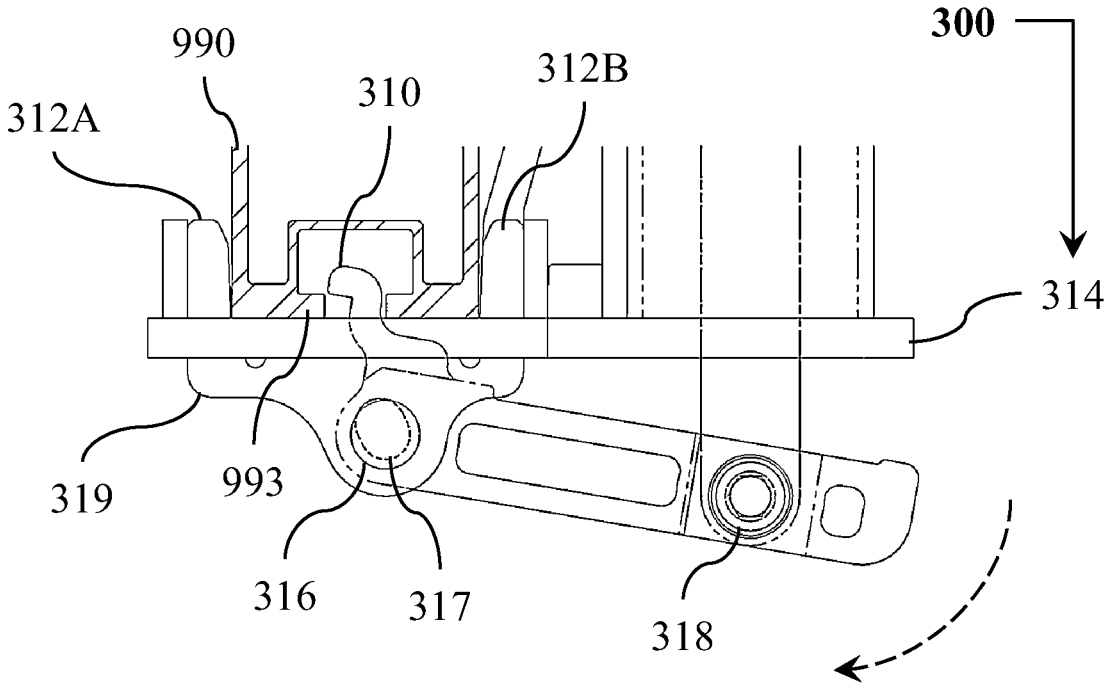
FIG. 19 is an enlarged side view illustrating a locking latch of the guardrail post holder in an unlocked position with the beam.
Figure 20:
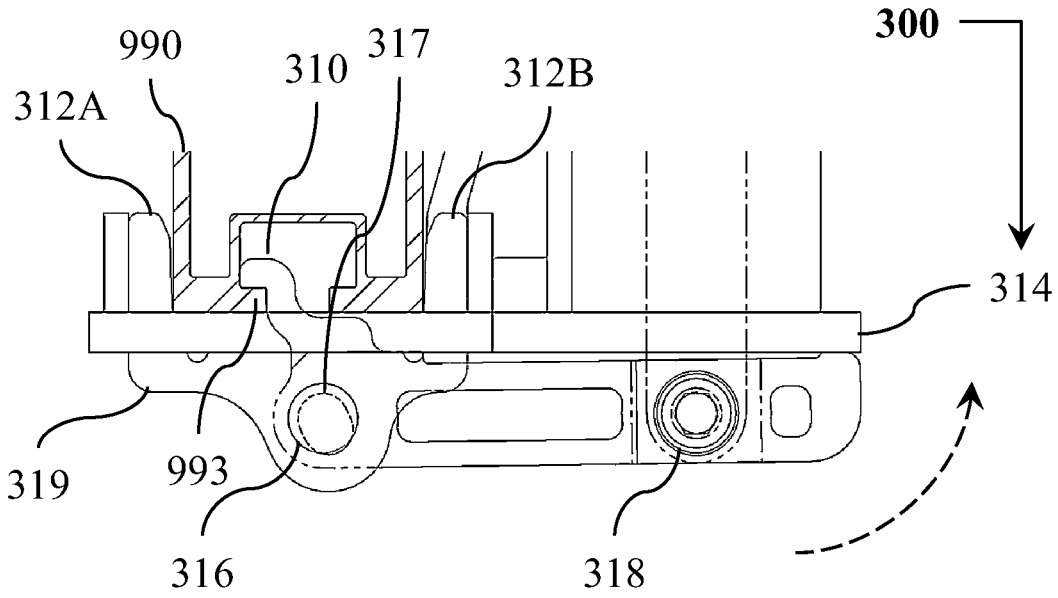
FIG. 20 is an enlarged side view illustrating the locking latch of FIG. 19 in a locked position with the beam.
Figure 21:
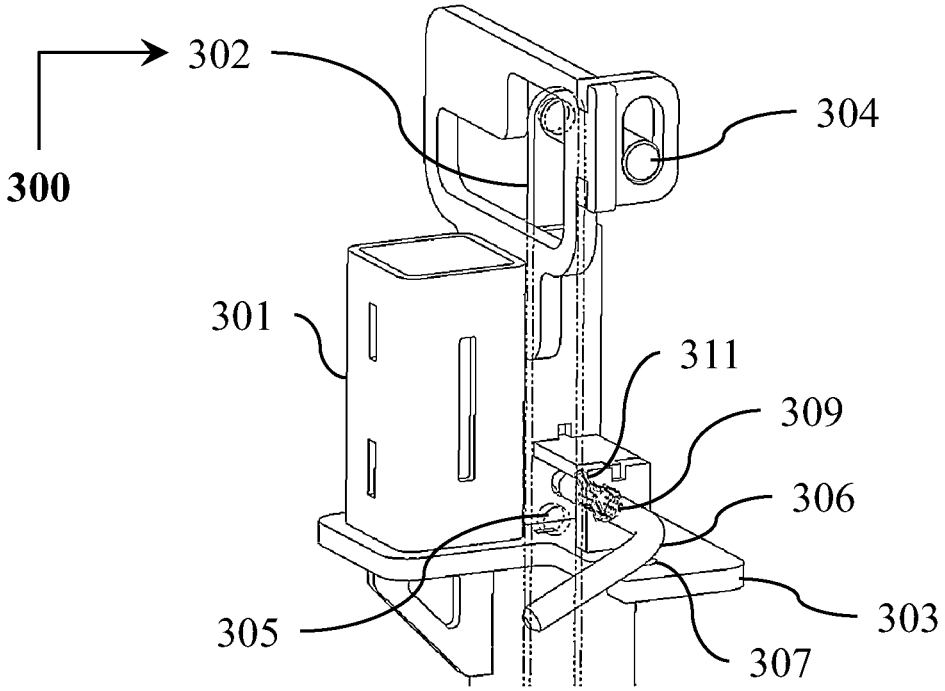
FIG. 21 is a perspective view illustrating a plunger pin of the guardrail post holder in an unlocked state with a guardrail post seat.
Figure 22:
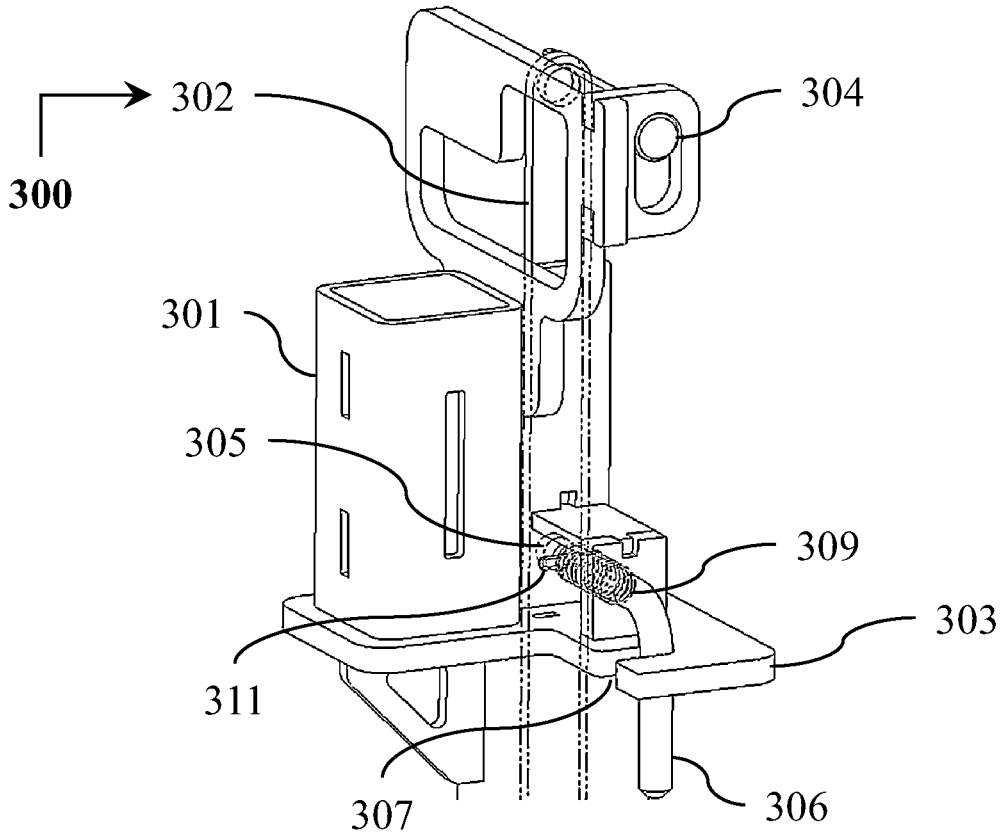
FIG. 22 is a perspective view illustrating the plunger pin of FIG. 21 in a locked state with the guardrail post seat.

Referring to the embodiments (implementations) as depicted in FIG. 14 and FIG. 15, the beam-side guardrail post bracket 300, in its installed position, is located to a lateral side section of the beam 990 (either the main beam 992 or the cross beam 994), as depicted in FIG. 15. The bottom section of the beam-side guardrail post bracket 300 is configured to selectively clamp to an engagement channel 991 located at a bottom portion of the beam 990 (as depicted in FIGS. 15 and 18). The mid-section of the beam-side guardrail post bracket 300 is configured to selectively engage just under the beam flange 997 (angled top flange) of the beam 990. The selective engagement and/or release of the articulated clamp head 310 is actuated by the flat-bar 302. The flat-bar 302 is pin-connected (via a hinge bolt 318) to the articulated clamp head 310 (positioned or located at the bottom of the beam-side guardrail post bracket 300). Pulling the flat-bar 302 upwardly (by pulling the trigger 304) pivots the articulated clamp head 310 into a clamped position (a locked position) (as depicted in FIG. 15, FIG. 18 and FIG. 20). Returning to FIG. 15, the horizontal portion of the spring-actuated plunger pin 306 is then forced into the plunge hole 305 that is formed in the flat-bar 302 (the plunge hole 305 is depicted in FIG. 16, FIG. 17, FIG. 21 and FIG. 22). Returning to FIG. 15, the horizontal movement of the spring-actuated plunger pin 306 into the plunge hole 305 of the flat-bar 302 is done in such a way that the bent tail section of the spring-actuated plunger pin 306 comes in line with the plunger-pin slot 307 (as depicted in FIG. 21 and FIG. 22) in the guardrail post seat 303. Under the effect of gravity, the bent tail end of the spring-actuated plunger pin 306 rotates down into the plunger-pin slot 307 (as depicted in FIG. 22). This action ensures that the spring-actuated plunger pin 306 is not accidentally pulled out of the plunge hole 305 in the flat-bar 302 (for the case where the spring-actuated plunger pin 306 is pulled out of the plunge hole 305 in the flat-bar 302, the flat-bar 302 drops vertically, which disengages the clamp head 310; it will be appreciated that for this condition to accidentally happen may be dangerous, as the beam-side guardrail post bracket 300 may become disengaged, potentially detach and may cause injury). In order for the spring-actuated plunger pin 306 to be disengaged from the plunge hole 305 in the flat-bar 302 (thereby disengaging the clamp head 310), first the bent tail end of the spring-actuated plunger pin 306 must be rotated out of the plunger-pin slot 307, and then the spring-actuated plunger pin 306 must be pulled horizontally (against a compression spring 309) away from the flat-bar 302. Once the spring-actuated plunger pin 306 is pulled out of the plunge hole 305, the flat-bar 302 falls under gravity, and the articulated clamp head 310 pivots into an unlocked position (a released position) in which it is no longer clamping the beam flange 993 (also called a lower flange) located at the bottom of the beam 990 (this released position is shown in FIG. 19). The beam-side guardrail post bracket 300 can then be detached from the beam 990.

Referring to the embodiments (implementations) as depicted in FIG. 14 and FIG. 15, the spring-actuated plunger pin 306 includes a horizontal portion and a bent tail section. The horizontal portion of the spring-actuated plunger pin 306 is forced into the plunge hole 305 in the flat-bar 302 once the flat-bar 302 is pulled up and the articulated clamp head 310 is engaged with (clamping down on) the beam flange 993. The plunge hole 305 is depicted in FIG. 16, FIG. 17, FIG. 21 and FIG. 22. Referring to FIG. 18 and FIG. 21, the flat-bar 302 is in the up position, and the spring-actuated plunger pin 306 is plunged into the plunge hole 305. Once the spring-actuated plunger pin 306 is positioned into the plunge hole 305 in the flat-bar 302, the bent tail section of the spring-actuated plunger pin 306 comes in-line with and slides (under the effect of gravity) into the plunger-pin slot 307. The bent tail section of the spring-actuated plunger pin 306 is trapped in the plunger-pin slot 307, preventing accidental disengagement of the spring-actuated plunger pin 306 from the plunge hole 305 in the flat-bar 302, which might inadvertently disengage the clamp head 310 (articulated clamp head). Disengagement of the spring-actuated plunger pin 306 from the plunge hole 305 in the flat-bar 302 is achieved by first manually rotating the bent tail section of the spring-actuated plunger pin 306 out of the plunger-pin slot 307, and then forcibly pulling the spring-actuated plunger pin 306 (against the compression spring 309) horizontally out of the plunge hole 305 in the flat-bar 302. The spring-actuated plunger pin 306 must be forcibly pulled out to allow the flat-bar 302 to slide down and disengage the articulated clamp head 310.

Figure 16:
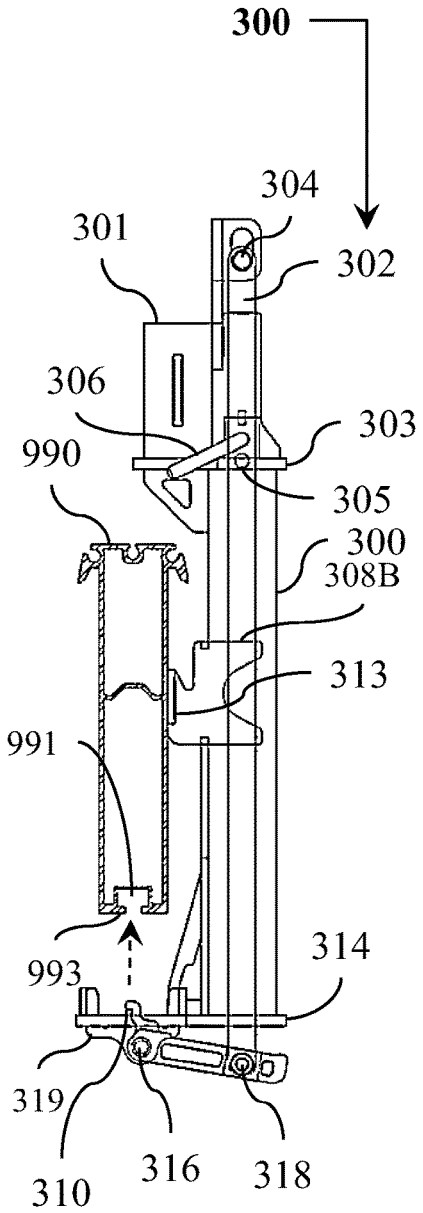
FIG. 16 is a side view illustrating the guardrail post holder of FIG. 15 in a detached state from the side of the beam.
Figure 17:
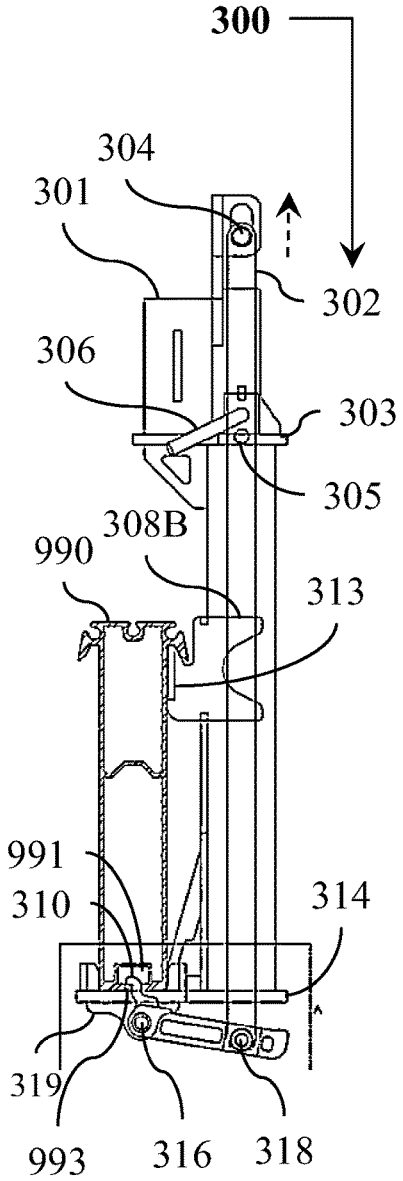
FIG. 17 is a side view illustrating the guardrail post holder of FIG. 15 in an unlocked state from the side of the beam.

Referring to the embodiments (implementations) as depicted in FIG. 14 and FIG. 15, the stabilizer plates (308A, 308B) are configured to engage under the beam flange 997 (also called an angled top flange) located at the top portion of the beam 990 (as depicted in FIG. 16 and FIG. 17). The stabilizer plates (308A, 308B) are installed at mid-height on either side of a spine, such as, for example, a central tube 320 (also called a central rectangular tube) of the beam-side guardrail post bracket 300. The stabilizer plate 313 is configured to engage with the beam top flange region of the beam 990. The stabilizer plates (308A, 308B) are configured to prevent the beam-side guardrail post bracket 300 from being pushed away from the beam side for the case where a horizontal load 927 is applied (as depicted in FIG. 15). The stabilizer plate 313 is configured to prevent the beam-side guardrail post bracket 300 from rotating around the axis perpendicular to the side of the beam 990. The stabilizer plate 313 is configured to engage with the beam surfaces in the region of the beam flange 997 (angled top flange) thereby preventing the beam-side guardrail post bracket 300 from inadvertently rotating around an axis that extends perpendicular to the vertical side face of the beam 990. It will be appreciated that the beam flange 993 is located at the bottom, and the clamp head 310 is located at the bottom and engages with the beam flange 993. The stabilizer plate 313 is configured to engage in the vicinity of beam flange 997.

Referring to the embodiments (implementations) as depicted in FIG. 14 and FIG. 15, the clamp head 310 (articulated clamp head) is configured to clamp down on the beam flange 993 located at the bottom of the beam 990 (as depicted in FIG. 15 and as depicted in FIG. 20). The stabilizer-plate tabs (312A, 312B) extend from the stabilizer plate 319. The stabilizer plate 319 includes the stabilizer-plate tabs (312A, 312B) configured to cradle around the bottom of the beam 990 (as depicted in FIG. 15).

Referring to the embodiments (implementations) as depicted in FIG. 14 and FIG. 15, the base plate 314 is configured to push up against that bottom of the beam 990 (as depicted in FIG. 15). The clamp-head pivot pin 316 is configured to be connected to the clamp head 310, allowing the clamp head 310 to rotate around the cylindrical axis of the clamp-head pivot pin 316. The clamp-head pivot pin 316 is configured to slide within the pin slot 317. The hinge bolt 318 is configured to connect the flat-bar 302 to the clamp head 310, forming a hinge joint so that the clamp head 310 can rotate around the cylindrical axis of the hinge bolt 318. The sliding hinge joint (created by the clamp-head pivot pin 316 sliding in the pin slot 317), coupled with the appropriately positioned hinge joint at the hinge bolt 318 is configured to form (provide) a linkage mechanism. The linkage mechanism is configured to allow the clamp head 310 to be moved between a locked (as depicted in FIG. 20) and unlocked position (as depicted in FIG. 19) via the vertical movement of the flat-bar 302.

Referring to the embodiment (implementation) as depicted in FIG. 15, the base plate 314 pushes up against the bottom of the beam 990. The clamp head 310 is configured to clamp down on the beam flange 993 at the bottom of the beam 990. The stabilizer-plate tabs (312A, 312B) are configured to cradle around the bottom of the beam 990. At around mid-height, the beam-side guardrail post bracket 300 is configured to selectively engage the beam 990 (that is, just under the beam flange 997 of the beam 990). Specifically, the stabilizer plates 308A and 308B of the beam-side guardrail post bracket 300 are configured to cradle under the beam flange 997 of the beam 990, and for the case where the horizontal load 927 is applied and transmitted at the guardrail post socket 301, the engagement of the stabilizer plates (308A, 308B) with the beam flange 997 prevent the beam-side guardrail post bracket 300 from being pushed away (and disengaged) from the beam 990.

Referring to the embodiment (implementation) as depicted in FIG. 14, formed in the stabilizer plate 313 are tabs (a pair of tabs) protruding vertically upward, which are configured to engage with the beam 990 in the region of the beam flange 997 (as depicted in FIG. 15). The engagement of the tabs of the stabilizer plate 313 in the region of the beam flange 997 is configured to stabilize the beam-side guardrail post bracket 300 by preventing rotation of the beam-side guardrail post bracket 300 around the axis that is perpendicular to the vertical side face of the beam 990. For the case where the beam-side guardrail post bracket 300 is secured to the beam 990, the trigger 304 and the flat-bar 302 are in the up position, and the clamp head 310, in use, clamps down on the beam flange 993 located in the bottom region of the beam 990.

Referring to the embodiments (implementations) as depicted in FIG. 16, FIG. 17 and FIG. 18, the sequential method of installation of the beam-side guardrail post bracket 300 is depicted.

Referring to the embodiment (implementation) as depicted in FIG. 16, the spring-actuated plunger pin 306 is disengaged (not inside the plunge hole 305 in the flat-bar 302). In this manner, the clamp head 310 is placed in a disengaged position that allows the clamp head 310 to be brought into the engagement channel 991 once (after) the beam-side guardrail post bracket 300 is pulled upwardly. The beam-side guardrail post bracket 300 is maneuvered into position so that stabilizer plate 313 (in use) touches the side of the beam 990, and the beam-side guardrail post bracket 300 is pulled up (as indicated by the arrow); this is done, preferably, so that the base plate 314 may eventually contact (at least in part) the bottom section of the beam 990, and the clamp head 310 may become positioned into the engagement channel 991.

Referring to the embodiment (implementation) as depicted in FIG. 17, the base plate 314 (of the beam-side guardrail post bracket 300) contacts (at least in part) the bottom surface of the beam 990. The spring-actuated plunger pin 306 is still disengaged (that is, not inside the plunge hole 305 in the flat-bar 302), and the clamp head 310 is still in a disengaged position (that is, not clamping down on the bottom instance of the beam flange 993 of the beam 990); for a close-up view of this arrangement, reference is made to FIG. 19. To secure the beam-side guardrail post bracket 300 to the beam 990, the trigger 304 is pulled up (as indicated by the arrow) (to actuate the flat-bar-302) so that the clamp head 310 will be positioned to clamp down on the beam flange 993.

Referring to the embodiment (implementation) as depicted in FIG. 18, the flat-bar 302 has been pulled up, thereby causing the clamp head 310 to be placed in an engaged position (that is, clamping down on the beam flange 993 of the beam 990 (for a close-up view of this engaged clamping position, reference is made to FIG. 20). The beam-side guardrail post bracket 300 is now secured to (mounted to) the beam 990.

Referring to the embodiment (implementation) as depicted in FIG. 19 (a close-up view of the lower portion of FIG. 17) the bottom region of the beam 990 is depicted for the case where the base plate 314 of the beam-side guardrail post bracket 300 contacts the bottom surface of the beam 990 and the clamp head 310 is in the disengaged position. After the clamp head 310 of the beam-side guardrail post bracket 300 enters the engagement channel 991, and the base plate 314 is in contact with the bottom surface of the beam 990, the articulated clamp head (as depicted in FIG. 19) is in the disengaged position. The trigger 304 is then pulled upwardly (as depicted by the arrow in FIG. 17). The spring-actuated plunger pin 306 will then plunge into the plunge hole 305 in the flat-bar 302. The articulated clamp head 310 is then engaged and clamps down on the beam flange 993 (as depicted in FIG. 20).

Referring to the embodiment (implementation) as depicted in FIG. 20 (a close-up view of the lower portion of FIG. 18), the articulated clamp head 310 is engaged and clamps down on the beam flange 993 at the bottom of the beam 990. For FIG. 19 and FIG. 20, the stabilizer-plate tabs (312A, 312B) of the stabilizer plate 319 are configured to cradle (at least in part) around bottom section of the beam 990. The upward or downward motion of the flat-bar 302 moves the clamp head 310 into a locked (engaged) or unlocked (disengaged) position, respectively, via the linkage mechanism comprising the stabilizer plate 319, the clamp head 310, the flat-bar 302, the clamp-head pivot pin 316 and the hinge bolt 318. The clamp-head pivot pin 316 slides in the pin slot 317 (which is formed in the stabilizer plate 319). The sliding action of the clamp-head pivot pin 316 creates (forms) a sliding hinge joint in which the front (clamping) portion of the clamp head 310 is allowed to pivot around the axis of the clamp-head pivot pin 316 that slides in the pin slot 317. The hinge bolt 318 connects the rear portion of the clamp head 310 to the flat-bar 302, and this arrangement creates a hinge joint at the rear of the clamp head 310. The combination of the hinge joint at the rear and the sliding hinge at the front section allows the clamp head 310 to be actuated into a locked position (when the flat-bar 302 is pulled up) (as depicted in FIG. 20) and an unlocked/disengaged position (when the flat-bar 302 drops vertically) (as depicted in FIG. 19).

Referring to the embodiment (implementation) as depicted in FIG. 21, a plunge hole 305 (shown in dashed lines) is configured to receive the horizontal portion of the spring-actuated plunger pin 306. The plunge hole 305 is formed in the flat-bar 302 and into which the spring-actuated plunger pin 306 is forced to move once the flat-bar 302 is pulled up and the clamp head 310 engages with (clamps down on) the beam flange 993 of the beam 990. The plunge hole 305 is defined (formed) in the flat-bar 302. Once the flat-bar 302 is pulled upwardly and the plunge hole 305 lines up with the horizontal portion of the spring-actuated plunger pin 306, the compression spring 309 is configured to move (force) the spring-actuated plunger pin 306 into the plunge hole 305. A fixed pin 311 is permanently mounted to the spring-actuated plunger pin 306. The fixed pin 311 extends radially from the spring-actuated plunger pin 306. The compression spring 309 pushes against the fixed pin 311, which causes the spring-actuated plunger pin 306 to plunge into the plunge hole 305 once the flat-bar 302 is moved upwardly. The compression spring 309 is configured to push against the fixed pin 311 in order to plunge the spring-actuated plunger pin 306 into the plunge hole 305. The compression spring 309 is configured to provide, at least in part, resistance against accidental disengagement of the spring-actuated plunger pin 306. The plunger-pin slot 307 is defined in the guardrail post seat 303. For the case where the bent tail end of the spring-actuated plunger pin 306 is not positioned in the plunger-pin slot 307 (as depicted in FIG. 21) (this arrangement may provide an important visual indication to the user), the spring-actuated plunger pin 306 has not found the plunge hole 305 in the flat-bar 302, and the clamp head 310 (as depicted in FIG. 19) is disengaged. Once the spring-actuated plunger pin 306 plunges into the plunge hole 305 of the flat-bar 302, the bent tail section of the spring-actuated plunger pin 306 is moved to be positioned in-line with the plunger-pin slot 307, and under gravity, the bent tail end of the spring-actuated plunger pin 306 rolls down (moves) into the plunger-pin slot 307 (this provides a visual indication to the user that the clamp head 310 is engaged with the beam flange 993, and the beam-side guardrail post bracket 300 is secured in place). When the spring-actuated plunger pin 306 (and clamp head 310) is disengaged, the bent tail end of the spring-actuated plunger pin 306 will always be positioned out of the plunger-pin slot 307 of the guardrail post seat 303 (as depicted in FIG. 21, and this provides an important visual indication to the user that the beam-side guardrail post bracket 300 is not securely in place, because the clamp head 310 is not yet clamping down on the beam flange 993).

Referring to the embodiment (implementation) as depicted in FIG. 22, the trigger 304 and the flat-bar 302 are moved upwardly. The spring-actuated plunger pin 306 is forced into the plunge hole 305 of the flat-bar 302. Once the spring-actuated plunger pin 306 is plunged into the plunge hole 305 of the flat-bar 302, the bent tail end of the spring-actuated plunger pin 306 is moved to be positioned in-line with the plunger-pin slot 307. Under gravity, the bent tail end of the spring-actuated plunger pin 306 rolls down into (moves into) the plunger-pin slot 307. When the bent tail end of the spring-actuated plunger pin 306 is received in the plunger-pin slot 307, the user is provided with a visual indication that the clamp head 310 is engaged. Accidental disengagement of the clamp head 310 is not possible, as pulling the spring-actuated plunger pin 306 out of the plunge hole 305 (also called a plunger-pin hole), thereby dropping the flat-bar 302 and disengaging the clamp head 310. This action initially requires manually rotating the bent tail end of the spring-actuated plunger pin 306 out of the plunger-pin slot 307 (see FIG. 22) and then pulling the spring-actuated plunger pin 306 out of the plunge hole 305 (acting against the force of the compression spring 309). The guardrail post seat 303 is configured (shaped) so that the guardrail post seat 303 facilitates visual inspection when the clamp head 310 is disengaged (as depicted in FIG. 19 that corresponds to FIG. 21) and when the articulated clamp head 310 is engaged (as depicted in FIG. 20 that corresponds to FIG. 22). Whenever the clamp head 310 is disengaged, the bent tail end of the spring-actuated plunger pin 306 is positioned out from the plunger-pin slot 307 (of the guardrail post seat 303) (as depicted in FIG. 21, corresponding to FIG. 19). Whenever the clamp head 310 is engaged, the spring-actuated plunger pin 306, in use, plunges into the plunge hole 305 in the flat-bar 302, and the bent tail section of the spring-actuated plunger pin 306 lines up with the plunger-pin slot 307. Under the effect of gravity, the bent tail section of the spring-actuated plunger pin 306 rotates down into the plunger-pin slot 307 of the guardrail post seat 303. This arrangement may provide a convenient visual cue that the clamp head 310 is engaged. Accidental disengagement of the spring-actuated plunger pin 306 (which would cause the flat-bar 302 to drop and thereby disengage the clamp head 310) is avoided because the bent tail section of the spring-actuated plunger pin 306 has to first be manually rotated out of the plunger-pin slot 307, and the spring-actuated plunger pin 306 then has to be forcibly pulled out horizontally from the plunge hole 305 in the flat-bar 302 (against the force of the compression spring 309). For the case where the flat-bar 302 and the trigger 304 are pulled upwardly, the clamp head 310 is engaged, and the spring-actuated plunger pin 306 plunges into the plunge hole 305 of the flat-bar 302, and the bent tail end of the spring-actuated plunger pin 306 moves into the plunger-pin slot 307 of the guardrail post seat 303.

Referring to the embodiment (implementation) as depicted in FIG. 23, instances of the beam-side guardrail post bracket 300 may be installed at spaced-apart positions (such as 300 millimeter increments) wherever there is a receiver channel 995 available. The receiver channel 995 is a region located at the bottom of the beam 990 (spaced apart, for instance, at 300 mm increments) in which portions of the lateral beam flanges 996 (also called outwardly protruding lower flanges) of the beam 990 have been removed so that the beam-side guardrail post bracket 300 or other components (such as, the prop head 902) can be placed in that region without interference with the lateral beam flanges 996 of the beam 990.

FIG. 24 to FIG. 35 depict perspective views (FIG. 24, FIG. 25, FIG. 26 and FIG. 27), side views (FIG. 28 and FIG. 29) and a perspective view (FIG. 30), a top view (FIG. 31), a side view (FIG. 32) and perspective views (FIG. 33, FIG. 34 and FIG. 35) of embodiments of the guardrail post holder 102 of FIG. 1, in which the guardrail post holder 102 includes a prop-head guardrail post bracket 400.

Figure 24:
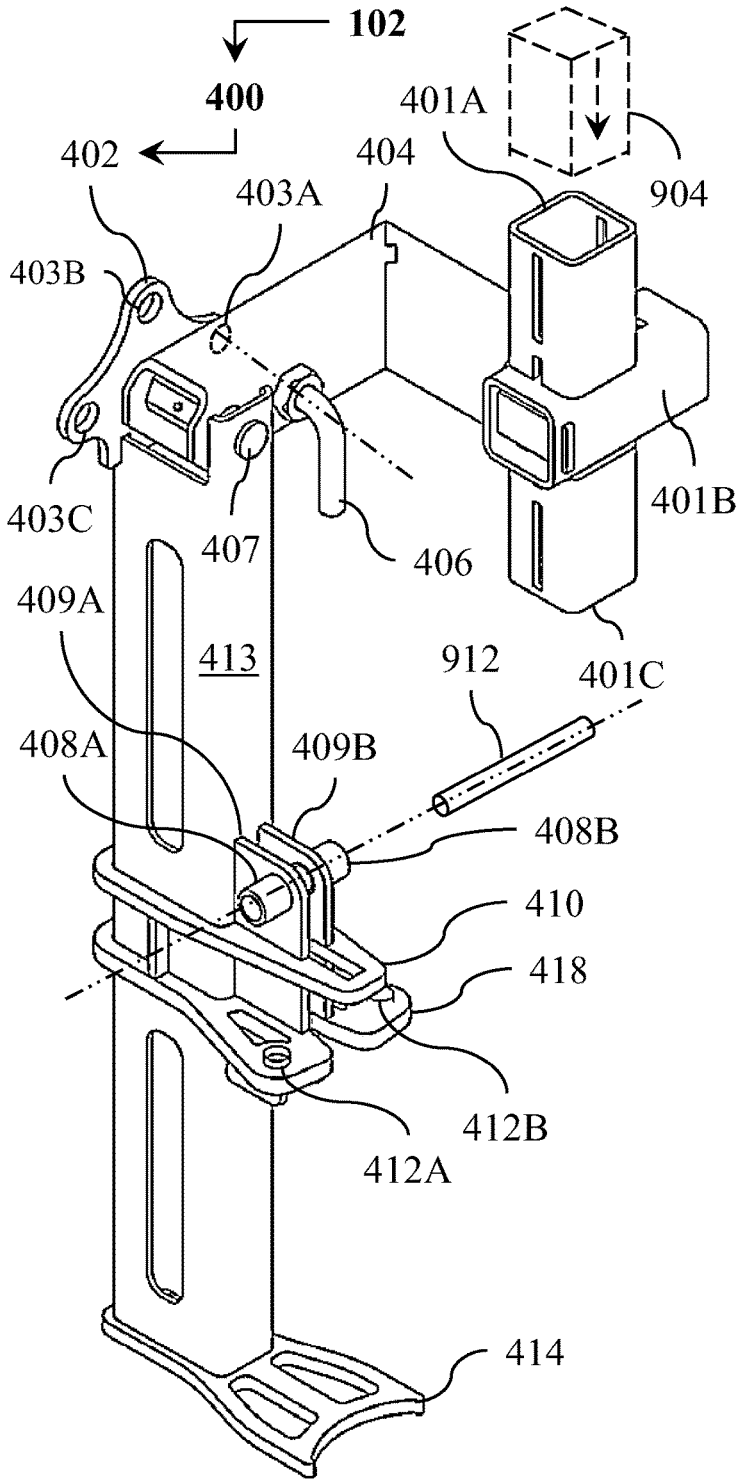
FIG. 24 is a perspective view of another embodiment of a guardrail post holder configured for engagement with a prop-head and having a pivot arm shown in a first configuration.
Figure 25:
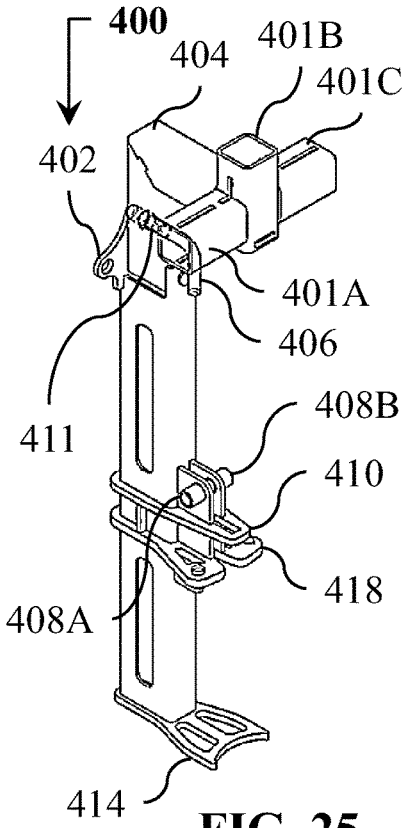
FIG. 25 is a perspective view illustrating the guardrail post holder of FIG. 24 with the pivot arm shown in a second configuration.
Figure 26:
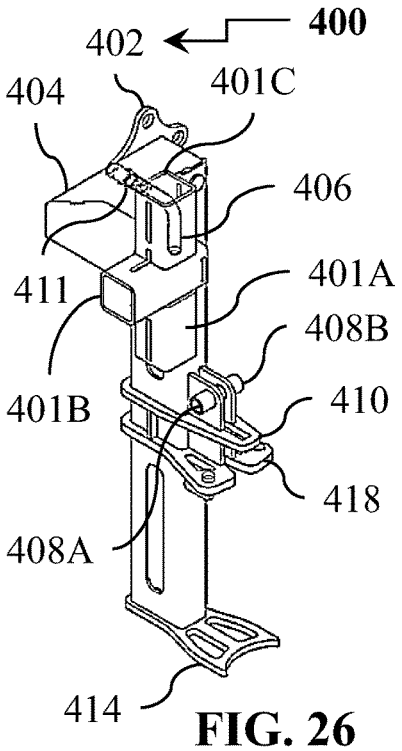
FIG. 26 is a perspective view illustrating the guardrail post holder of FIG. 24 with the pivot arm shown in a third configuration.
Figure 28:
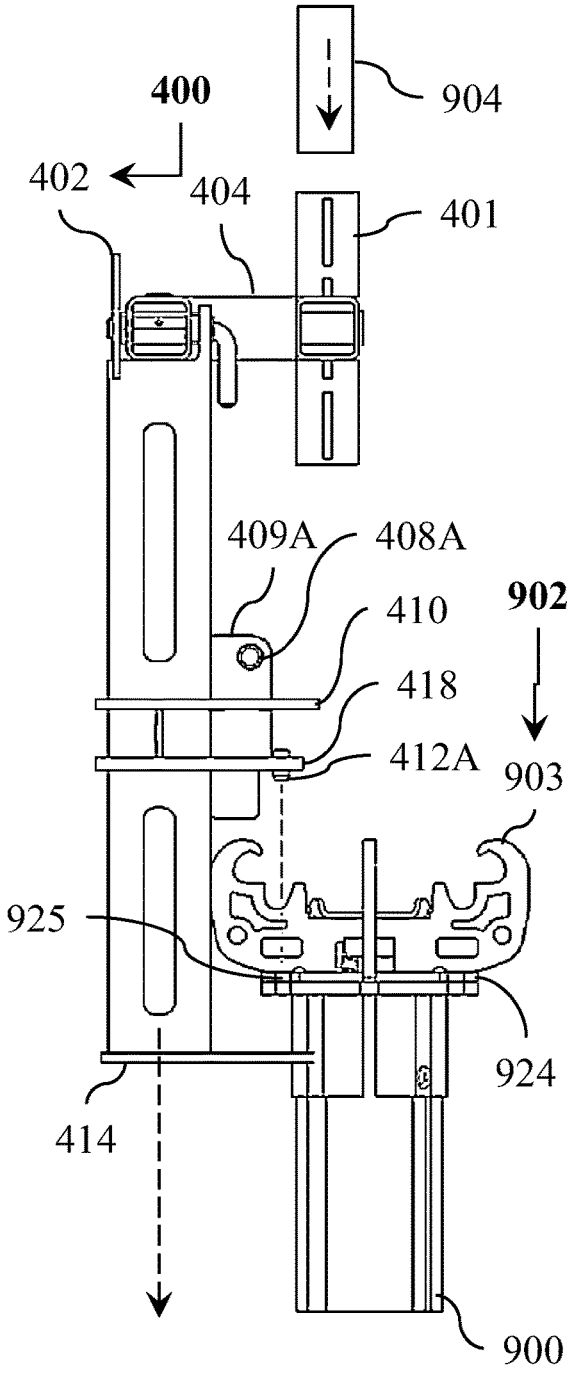
FIG. 28 is a side view illustrating the guardrail post holder of FIG. 24 with a socket thereof positioned for receiving a vertical guide post rail.
Figure 29:
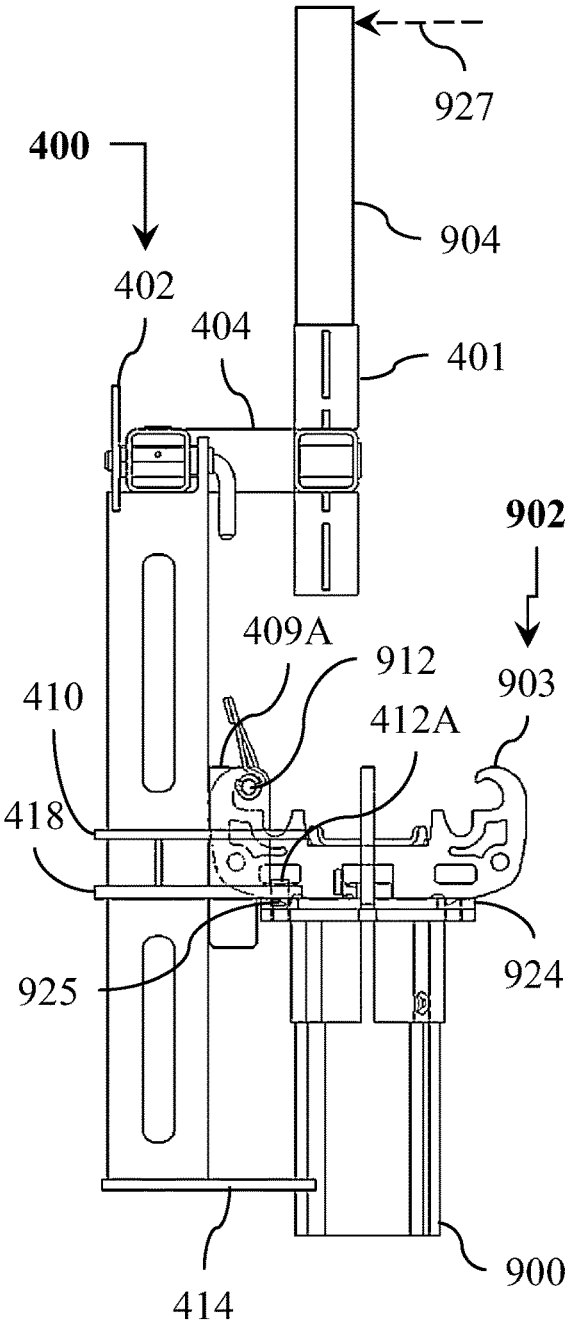
FIG. 29 is a side view illustrating the guardrail post holder of FIG. 24 with the socket thereof having the vertical guide post rail received therein.
Figure 30:
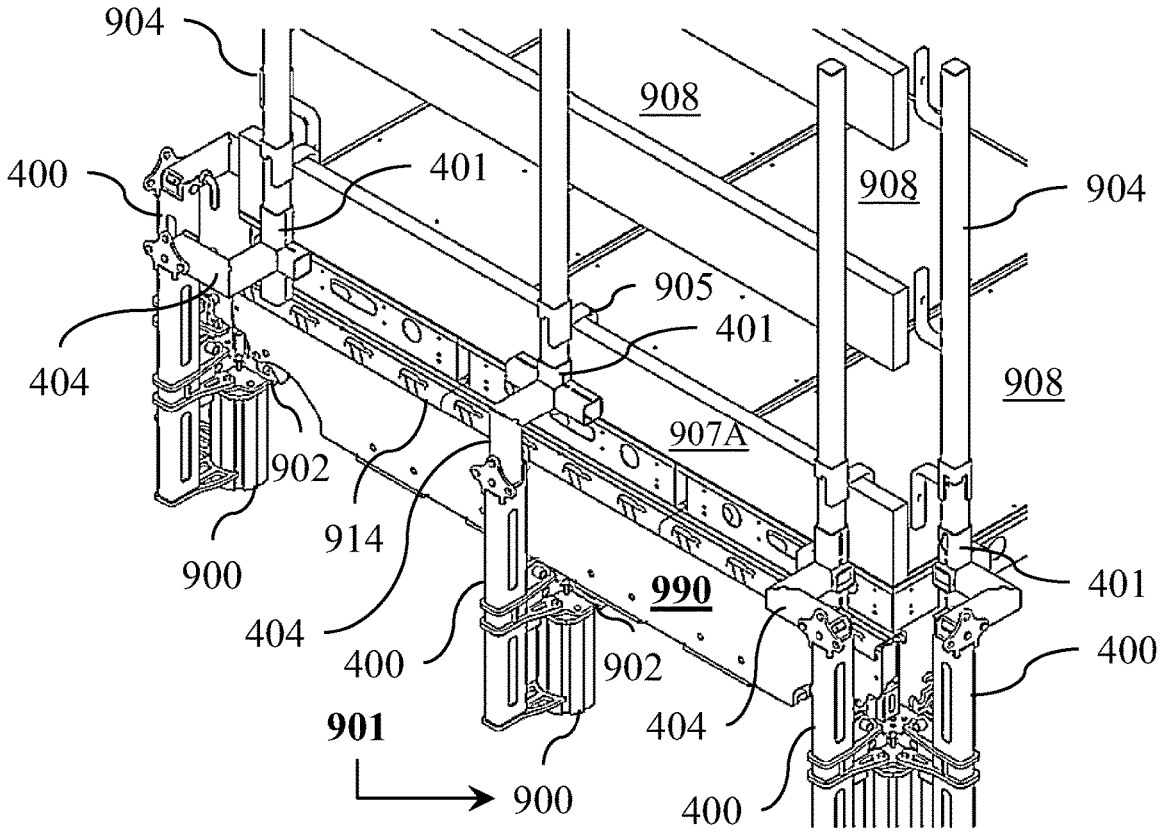
FIG. 30 is a side perspective view illustrating a plurality of the guardrail post holders of FIG. 24 attached to respective prop heads.

Referring to the embodiments (implementations) as depicted in FIG. 24, FIG. 25 and FIG. 26 (all perspective views), the guardrail post holder 102 includes the prop-head guardrail post bracket 400. The prop-head guardrail post bracket 400 is configured to attach to the prop head 902 (such as, for the case where the prop head 902 is installed to support the beam 990 and the prop-head hook 903 is not obstructed by another beam (as depicted in FIG. 30). Returning to FIG. 24, the safety pin 912 is configured to attach (selectively attach) the prop-head guardrail post bracket 400 to the prop head 902 (the attachment is depicted in FIG. 28 and FIG. 29). Returning to FIG. 24, the prop-head guardrail post bracket 400 is configured to attach (to be fixedly attached) to the prop head 902 for the case where (a) the prop head 902 is located (installed) at the end section of the beam 990 (as depicted in FIG. 30), or (b) the prop head 902 is positioned underneath the beam 990 as an intermediate support (as depicted in FIG. 30). Returning to FIG. 24, a selected one of the guardrail post sockets (401A, 401B, 401C) is configured to receive and support the vertical guardrail post 904 (depending on the orientation of the guardrail post sockets (401A, 401B, 401C) for receiving the vertical guardrail post 904). The guardrail post sockets (401A, 401B, 401C) are configured to be pivotally movable via the pivot arm 404 to which they are attached. As depicted in FIG. 24, the guardrail post socket 401A has been oriented to face vertically upward (for receiving the vertical guardrail post 904). As depicted in FIG. 25, the guardrail post socket 401B has been oriented to face vertically upward (for receiving the vertical guardrail post 904). As depicted in FIG. 26, the guardrail post socket 401C has been oriented to face vertically upward (for receiving the vertical guardrail post 904). Returning to FIG. 24, the guardrail post sockets (401A, 401B, 401C) are configured to extend from each other in an orthogonal arrangement (that is, 90 degrees apart). The guardrail post sockets (401A, 401B, 401C) are affixed to each other and to the pivot arm 404. The pivot arm 404 is configured to be pivotally movable or secured (selectively oriented) in a selected one position of three positions (via a pivot point 407). Once the pivot arm 404 is pivotally moved to a desired one of three positions, the spring-actuated plunger pin 406 is utilized. The guardrail post sockets (401A, 401B, 401C) are fixedly attached to the pivot arm 404. The pivot arm 404 is configured to be selectively pivoted and oriented, when needed, into alternate positions (as depicted in FIG. 24, FIG. 25 and FIG. 26) to prevent the guardrail post sockets (401A, 401B, 401C) from interfering with other components. The spring-actuated plunger pin 406 is configured to selectively lock the pivot arm 404 in one of three positions (at three fixed positions by engaging with the fixed plunge-hole plate 402), thereby orienting the guardrail post sockets (401A, 401B, 401C) in a respective selected position. The spring-actuated plunger pin 406 is configured to lock the pivot arm 404 in one of three positions (depending on which of the engagement-plunge holes (403A, 403B, 403C) into which the spring-actuated plunger pin 406 is plunged), which in turn selectively orients one of the guardrail post sockets (401A, 401B or 401C) in a vertically upright position ready to receive the guardrail post. Once one of the guardrail post socket (401A, 401B, 401C) is positioned in a vertically upright position, the vertically upright guardrail post socket is ready to receive the vertical guardrail post 904. The spring-actuated plunger pin 406 is configured to engage a selected one of the engagement-plunge holes (403A, 403B, 403C) formed on the plunge-hole plate 402 (depending on the amount of rotation of the plunge-hole plate 402). The plunge-hole plate 402 is fixedly attached to a spine, such as, for example, a base member 413. The plunge-hole plate 402 does not rotate with the pivot arm 404. The base member 413 is configured to remain stationary once the prop-head guardrail post bracket 400 is attached to the prop head 902, etc.

Figure 33:
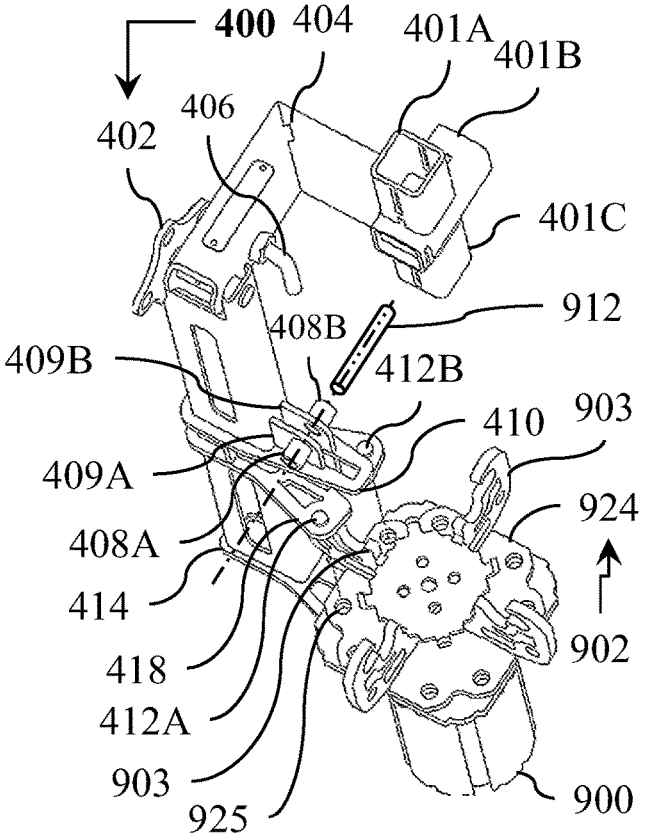
FIG. 33 is a top perspective view illustrating the guardrail post holder of FIG. 24 attached to a prop head.
Figure 34:
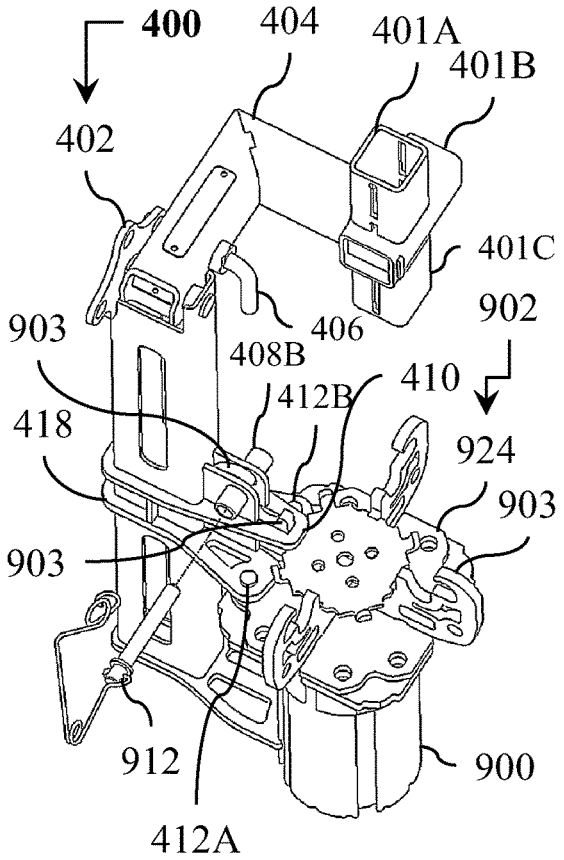
FIG. 34 is a top perspective view illustrating the guardrail post holder of FIG. 33 with a safety pin shown detached from the guardrail post holder.
Figure 35:
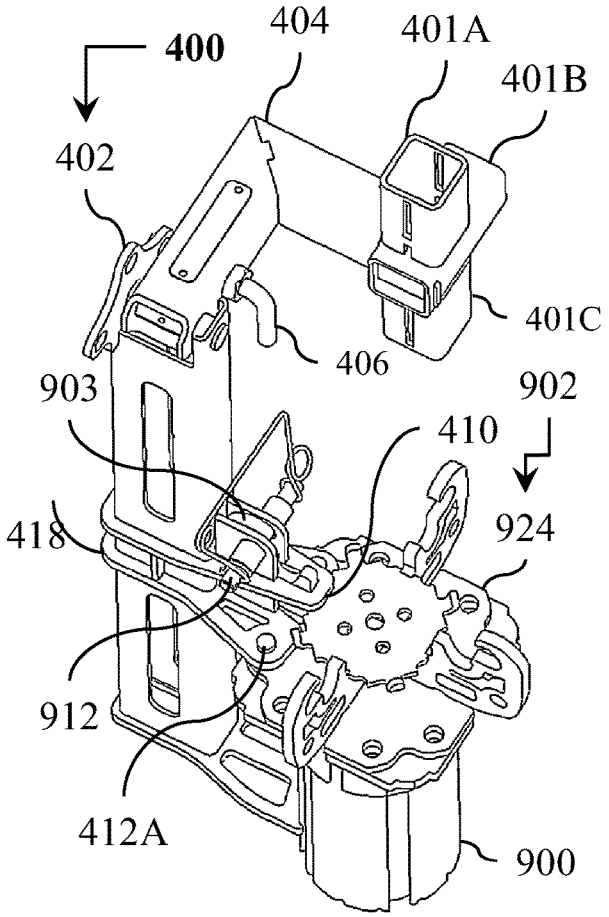
FIG. 35 is a top perspective view illustrating the guardrail post holder of FIG. 34 with the safety pin shown securing the guardrail post holder to the prop head.

Referring to the embodiments (implementations) as depicted in FIG. 24, FIG. 25 and FIG. 26, the stabilizer plate 410 is attached to the base member 413. The stabilizer plate 410 is configured to cradle around the prop-head hook 903 of the prop head 902 (as depicted in FIG. 29 and FIG. 33). Returning to FIG. 24, the safety-pin receivers (408A, 408B) are attached to the channel plates (409A, 409B), respectively. The channel plates (409A, 409B) are attached to the base member 413 and the stabilizer plate 410 (also may be called a torsional-resistance plate) and the torsional-resistance plate 418. When the prop-head guardrail post bracket 400 is installed in place, the channel plates (409A, 409B) cradle around (at least in part) the prop-head hook 903 (as depicted in FIG. 34 and FIG. 35). The safety-pin receivers (408A, 408B) are configured to receive the safety pin 912 once (after) the prop-head guardrail post bracket 400 is installed onto a prop head 902 (as depicted in FIG. 34 and FIG. 35).

Referring to the embodiments (implementations) as depicted in FIG. 24, FIG. 25 and FIG. 26, the torsional resistance pins (412A, 412B) are permanently fixed to the torsional-resistance plate 418. The torsional-resistance plate 418 is attached to the base member 413. The torsional resistance pins (412A, 412B) are configured to drop into the prop-head horizontal base plate 924 (the base plate) of the prop head 902 (as depicted in FIG. 28 and FIG. 29). The torsional resistance pins (412A, 412B) are configured to provide resistance in response to the application of a torsional load that may be transmitted by eccentric loading of a selected one of the guardrail post sockets (401A, 401B, 401C).

Referring to the embodiments (implementations) as depicted in FIG. 24, FIG. 25 and FIG. 26, the stabilizer plate 414 is configured to push against the prop 900 in response to application of a horizontal load 927 to a selected one of the guardrail post sockets (401A, 401B, 401C), as depicted in FIG. 29.

Referring to the embodiments (implementations) as depicted in FIG. 24, FIG. 25 and FIG. 26, the safety pin 912 is configured to be installed into the safety-pin receivers (408A, 408B) to secure the prop-head guardrail post bracket 400 to the prop head 902, as depicted in FIG. 29.

Referring to the embodiments (implementations) as depicted in FIG. 24, FIG. 25 and FIG. 26, there are three different positions of the pivot arm 404, to which the guardrail post sockets (401A, 401B, 401C) are attached, shown rotated counter-clockwise with each step. The spring-actuated plunger pin 406 is configured to plunge into a corresponding (respective) instance of the engagement-plunge hole (403A, 403B, 403C), and to selectively lock the pivot arm 404 and a respective instance of the guardrail post sockets (401A, 401B, 401C) at a selected orientation.

Referring to the embodiment (implementation) as depicted in FIG. 27 (a perspective view), there is depicted a close-up view of FIG. 24. The spring-actuated plunger pin 406 is used with a compression spring 411 (depicted in dashed line). The compression spring 411 is configured to plunge (move) the spring-actuated plunger pin 406 into, for instance, the engagement-plunge hole 403B of the plunge-hole plate 402. The compression spring 411 is configured to be normally biased to urge the spring-actuated plunger pin 406 into a selected one of the engagement-plunge holes (403A, 403B, 403C) of the plunge-hole plate 402. To select another hole, the spring-actuated plunger pin 406 is pulled away (this movement overcomes the force of the compression spring 411 and the compression spring 411 becomes compressed), the pivot arm 404 is rotated and the spring-actuated plunger pin 406 is released to allow it to plunge into a plunge hole of the plunge-hole plate 402. The pivot arm 404 includes (preferably) an L-shaped portion at the end of which the guardrail post sockets (401A, 401B and 401C) are attached.

Referring to the embodiments (implementations) as depicted in FIG. 28 and FIG. 29 (side views), the prop-head guardrail post bracket 400 is placed into position on the prop head 902 (as depicted in FIG. 28). The torsional resistance pins (412A, 412B) are permanently fixed to the torsional-resistance plate 418. The torsional resistance pins (412A, 412B) are configured to be guided into the corresponding instance of the pin-receivers 925 (holes) defined in the prop-head horizontal base plate 924 of the prop head 902.

Referring to the embodiment (implementation) as depicted in FIG. 29, the horizontal load 927 is applied (to the vertical guardrail post 904) and transmitted to the guardrail post socket 401. The safety pin 912 is configured to prevent the prop-head guardrail post bracket 400 from lifting up (and away from the prop head 902) and/or from disengaging from the prop head 902. The torsional resistance pins (412A, 412B) are configured to engage with the corresponding instance of the pin-receivers 925 of the prop-head horizontal base plate 924.

Figure 3:
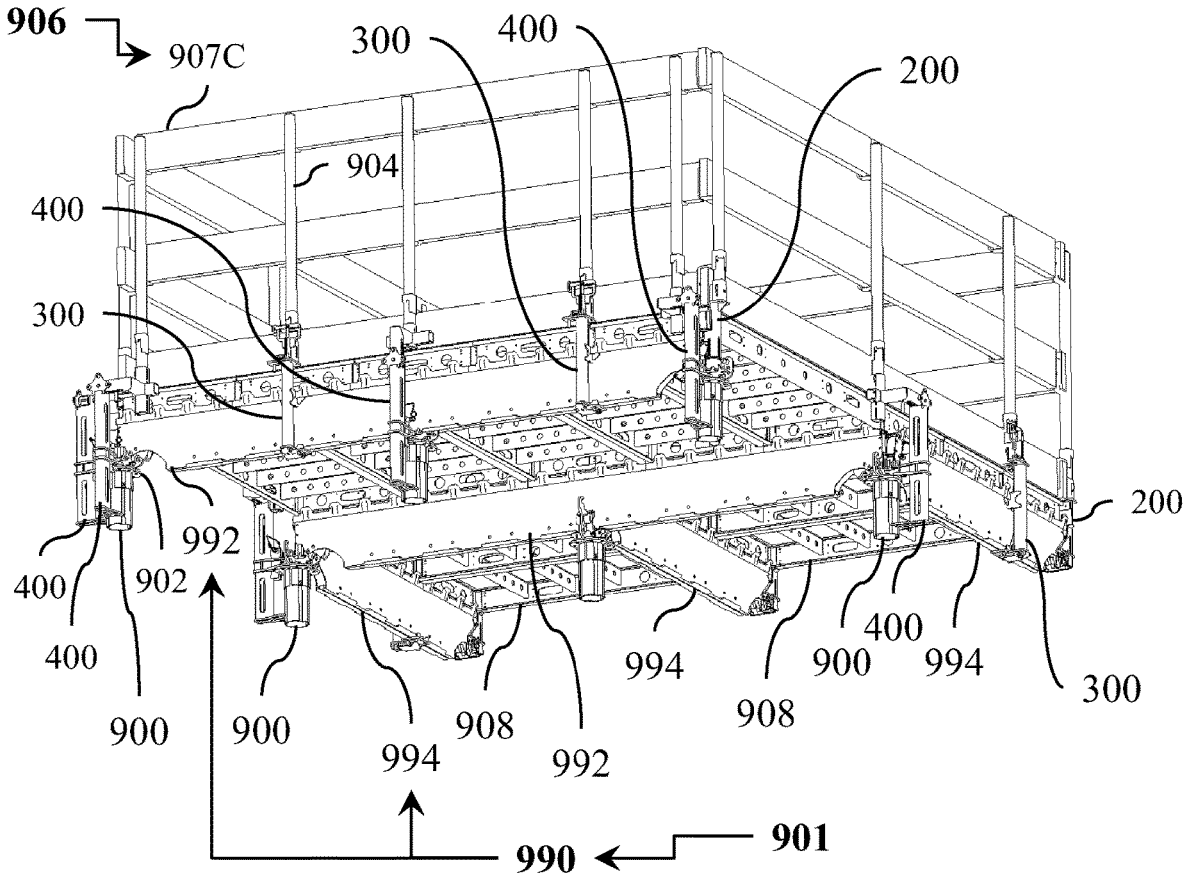
FIG. 3 is a bottom, perspective view illustrating the guardrail post holder and guardrail assembly of FIG. 2.
Figure 4:
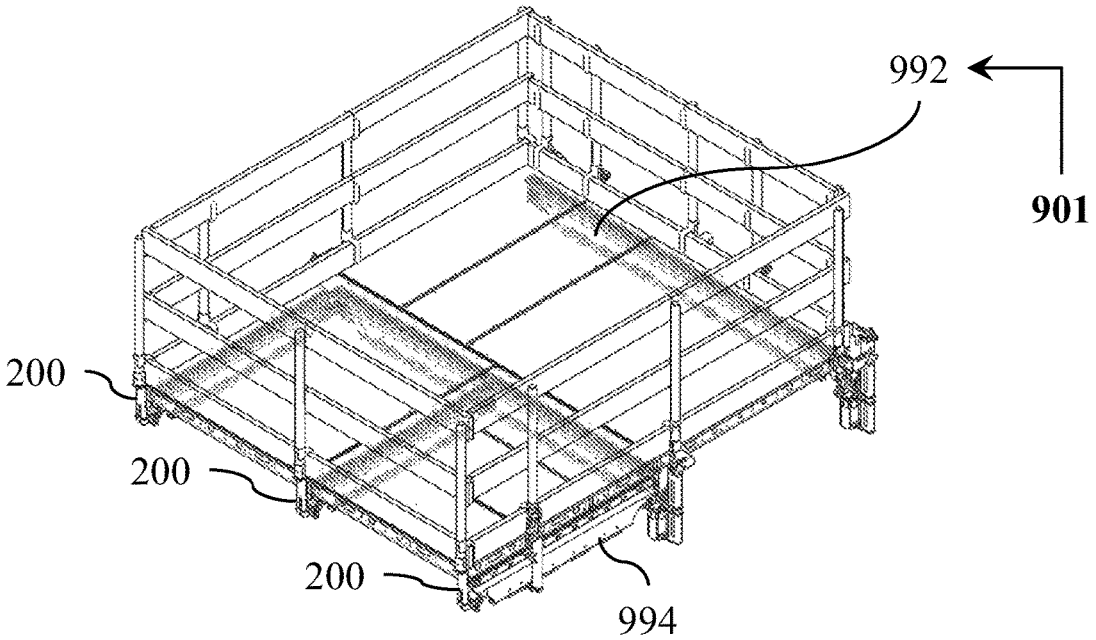
FIG. 4 is another perspective view of the guardrail post holder and guardrail assembly of FIG. 2.

The torsional resistance pins (412A, 412B) provide critical resistance to the torsional load transmitted by any eccentric loading of the guardrail post socket 401 due to the horizontal load 927 that is applied. The stabilizer plate 414 is configured to kick back against the prop 900 in response to the transmission of the horizontal load 927 applied to the guardrail post socket 401. In response to application of the horizontal load 927, the torsional resistance pins (412A, 412B) positioned inside the corresponding instance of the pin-receivers 925 provide stabilizing action. The stability of the prop-head guardrail post bracket 400 is ensured by (i) the stabilizing action of the stabilizer plate 414 including kicking back against the prop 900, (ii) the stabilizing action of the safety pin 912 preventing disengagement of the prop-head guardrail post bracket 400 from the prop-head hook 903 of the prop head 902, and (iii) the resistance to torsional loads provided by the torsional resistance pins (412A, 412B). The prop-head guardrail post bracket 400 is configured to securely hold in place the vertical guardrail post 904. The vertical guardrail post 904 is used to secure the horizontal guardrails 906 for providing a safely enclosed perimeter along the edges of the panels 908 (as depicted in FIG. 2, FIG. 3 or FIG. 4).

Referring to the embodiment (implementation) as depicted in FIG. 30 (a perspective view), the three different positions of the pivot arm 404, to which the guardrail post sockets (401A, 401B, 401C) are attached, allow the prop-head guardrail post bracket 400 to be used with the prop head 902 for the case where the prop head 902 is installed for supporting the beam 990 and/or for the case where the prop-head hook 903 is unobstructed by another beam 990.

Figure 31:
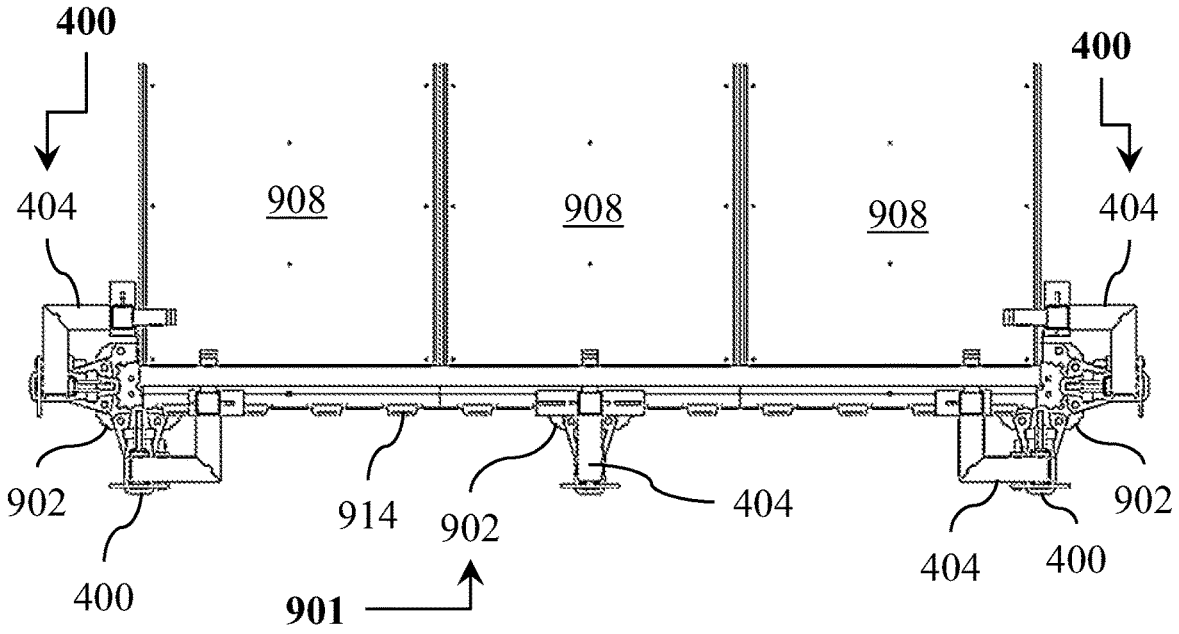
FIG. 31 is a top view illustrating the guardrail post holders of FIG. 24 attached to the respective prop heads.

Referring to the embodiment (implementation) as depicted in FIG. 31 (a top view), at corners where the prop head 902 supports (in use) the end of the beam 990, and where the prop-head hook 903 is unobstructed by another beam 990, the prop-head guardrail post bracket 400 may be installed in two directions. The variable orientation of the pivot arm 404 ensures that adjacent instances of the guardrail post sockets (401A, 401B, 401C) do not interfere with one another.

Figure 32:
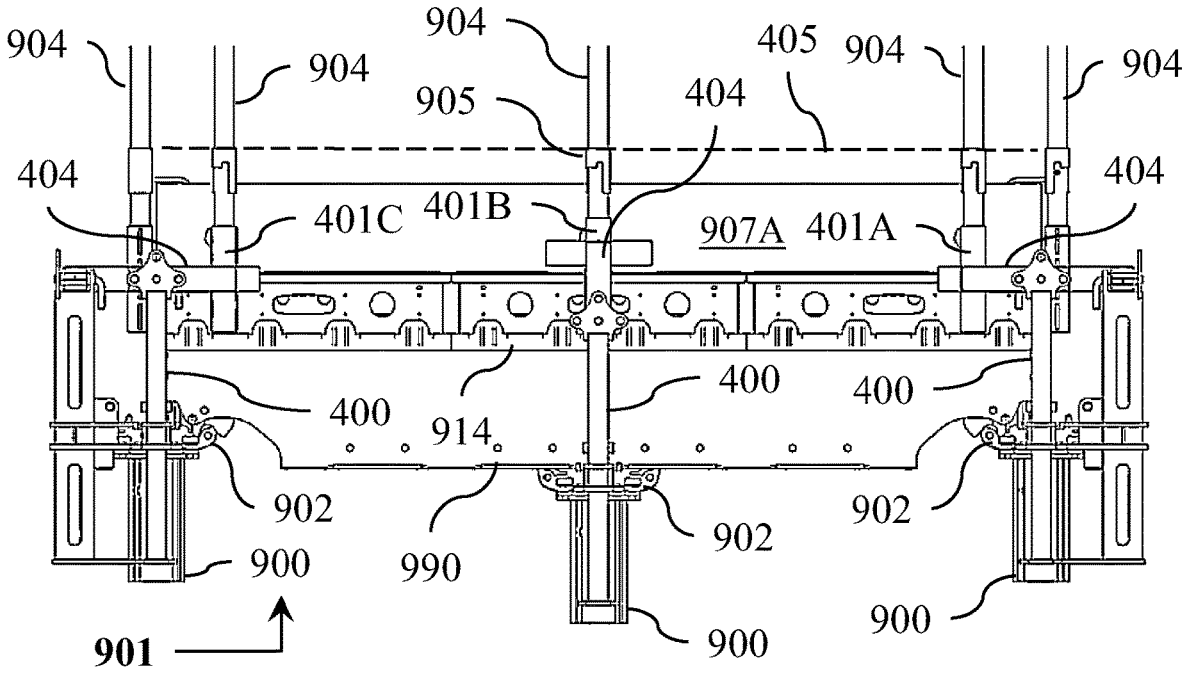
FIG. 32 is a side view illustrating the guardrail post holders of FIG. 24 attached to the respective prop heads.

Referring to the embodiment (implementation) as depicted in FIG. 32 (a side view), for the case where the prop-head guardrail post bracket 400 is installed on the prop head 902 that is supporting the beam 990 intermediately at the underside of the beam 990, the pivot arm 404 is pivoted to an upright position so that the elevation of the vertically upright instance of the guardrail post socket (401B), once installed, is maintained relative to the remaining instances of the guardrail post sockets (401A, 401C), such as where the prop-head guardrail post bracket 400 is installed on the prop head 902 that supports the end of the beam 990. Regardless of the selected orientation of the pivot arm 404, the guardrail post socket (401A, 401B or 401C) that is aligned in the vertically upright position may receive a respective instance of the vertical guardrail post 904, and has an elevation height that matches the elevation heights of the guardrail post socket 201 (of the beam-end guardrail post bracket 200) and/or the guardrail post socket 301 of the beam-side guardrail post bracket 300 wherever they may be installed. The purpose of maintaining the elevation heights of various types of the guardrail post sockets (401, 301, 201) that, once installed, receive the vertical guardrail post 904, is to ensure that the instances of the vertical guardrail post 904 are resting at the same elevation height 405; this arrangement ensures that the post hooks 905 of the vertical guardrail post 904 are at the same elevation height; otherwise, the horizontal guardrails might tilt according to the varying elevation heights of the post hooks 905. Regardless of the selected orientation of the pivot arm 404 (that is to say, regardless of which instance of the guardrail post socket 401A, 401B or 401C is placed and aligned in the vertically upright position to receive the vertical guardrail post 904), the seat on which the bottom of the vertical guardrail post 904 sits or rests is at the same elevation height in all instances; this ensures that the elevation heights of the post hooks 905 are maintained (relative to each other).

Referring to the embodiment (implementation) as depicted in FIG. 33 (a perspective view), the stabilizer plate 410 and the channel plates (409A, 409B) are configured to cradle around the prop-head hook 903 once the prop-head guardrail post bracket 400 is installed in place.

The corresponding instance of the pin-receivers 925 of the prop-head horizontal base plate 924 are configured to receive the torsional resistance pins (412A, 412B) of the prop-head guardrail post bracket 400. The torsional resistance pins (412A, 412B) are permanently fixed in the torsional-resistance plate 418. The torsional resistance pins (412A, 412B) are guided into the corresponding instance of the pin-receivers 925 of the prop-head horizontal base plate 924. The stabilizer plate 410 and the channel plates (409A, 409B) are configured to cradle around the prop-head hook 903 of the prop head 902 once the prop-head guardrail post bracket 400 is installed in place. The torsional resistance pins (412A, 412B), permanently fixed to the torsional-resistance plate 418, are configured to drop into the corresponding instance of the pin-receivers 925 of the prop-head horizontal base plate 924 of the prop head 902. The prop head 902 includes the prop-head horizontal base plate 924 (also called a base plate). The prop head 902 includes the prop-head hook 903 extending vertically upward.

Referring to the embodiment (implementation) as depicted in FIG. 34 (a perspective view), the safety pin 912 is configured to be inserted into the safety-pin receivers (408A, 408B) of the prop-head guardrail post bracket 400. Once the safety pin 912 is installed, the safety pin 912, in use, prevents the prop-head guardrail post bracket 400 from being pulled up and off of the prop head 902. The safety pin 912 is configured to be installed into the safety-pin receivers (408A, 408B) after the prop-head guardrail post bracket 400 is installed onto the prop head 902.

Referring to the embodiment (implementation) as depicted in FIG. 35 (a perspective view), the safety pin 912 is installed into the safety-pin receivers (408A, 408B) to secure the prop-head guardrail post bracket 400 to the prop head 902.

The following is offered as further description of the embodiments, in which any one or more of any technical feature (described in the detailed description, the summary and the claims) may be combinable with any other one or more of any technical feature (described in the detailed description, the summary and the claims). It is understood that each claim in the claims section is an open ended claim unless stated otherwise. Unless otherwise specified, relational terms used in these specifications should be construed to include certain tolerances that the person skilled in the art would recognize as providing equivalent functionality. By way of example, the term perpendicular is not necessarily limited to 90.0 degrees, and may include a variation thereof that the person skilled in the art would recognize as providing equivalent functionality for the purposes described for the relevant member or element. Terms such as "about" and "substantially", in the context of configuration, relate generally to disposition, location, or configuration that are either exact or sufficiently close to the location, disposition, or configuration of the relevant element to preserve operability of the element within the disclosure which does not materially modify the disclosure. Similarly, unless specifically made clear from its context, numerical values should be construed to include certain tolerances that the person skilled in the art would recognize as having negligible importance as they do not materially change the operability of the disclosure. It will be appreciated that the description and/or drawings identify and describe embodiments of the apparatus (either explicitly or inherently). The apparatus may include any suitable combination and/or permutation of the technical features as identified in the detailed description, as may be required and/or desired to suit a particular technical purpose and/or technical function. It will be appreciated that, where possible and suitable, any one or more of the technical features of the apparatus may be combined with any other one or more of the technical features of the apparatus (in any combination and/or permutation). It will be appreciated that persons skilled in the art would know that the technical features of each embodiment may be deployed (where possible) in other embodiments even if not expressly stated as such above. It will be appreciated that persons skilled in the art would know that other options may be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the word "includes" is equivalent to the word "comprising" in that both words are used to signify an open-ended listing of assemblies, components, parts, etc. The term "comprising", which is synonymous with the terms "including," "containing," or "characterized by," is inclusive or open-ended and does not exclude additional, unrecited elements or method steps. Comprising (comprised of) is an "open" phrase and allows coverage of technologies that employ additional, unrecited elements. When used in a claim, the word "comprising" is the transitory verb (transitional term) that separates the preamble of the claim from the technical features of the disclosure. The foregoing has outlined the non-limiting embodiments (examples). The description is made for particular non-limiting embodiments (examples). It is understood that the non-limiting embodiments are merely illustrative as examples.

What is claimed is:

1. A guardrail post holder for coupling a guardrail assembly to a formwork system, the guardrail post holder comprising:

a spine having a top end portion, and a bottom end portion;

a socket coupled to the top end portion of the spine and configured for receiving a guardrail post of the guardrail assembly;

a plate coupled to the bottom end portion of the spine and configured to selectively secure the guardrail post holder to a formwork support component of the formwork system, wherein the plate includes a pair of plates coupled to the bottom end portion of the spine and laterally spaced from one another to define a gap therebetween, the gap being configured to receive an end of the formwork support component to prevent the guardrail post holder from rotating about a longitudinal axis of the formwork support component, wherein the pair of plates are parallel to one another;

a safety pin, wherein the pair of plates each define a hole therethrough configured for receipt of the safety pin, wherein the safety pin is configured to be received through the holes in a direction perpendicular to the pair of plates; and a toe-board stop plate protruding outwardly from the socket to maintain a gap between the formwork support component of the formwork system and the top end portion of the spine.

2. The guardrail post holder of claim 1, further comprising a stop plate spanning the gap and interconnecting the pair of plates, wherein the stop plate is configured for flush engagement with a head of the formwork system.

3. The guardrail post holder of claim 2, further comprising a panel seat extending perpendicularly relative to the stop plate, wherein the panel seat is configured to support a cantilevering portion of a panel of the formwork system.

4. The guardrail post holder of claim 1, wherein the bottom end portion of the spine has an inclined support surface.

5. The guardrail post holder of claim 1, further comprising a skirt disposed toward a bottom portion of the spine, wherein the skirt is configured to provide structural rigidity to the spine.

* * * * *